US009612544B2

(12) United States Patent
Nakagawa et al.

(10) Patent No.: US 9,612,544 B2
(45) Date of Patent: Apr. 4, 2017

(54) ELECTROSTATIC IMAGE DEVELOPING TONER

(71) Applicant: MITSUBISHI CHEMICAL CORPORATION, Chiyoda-ku (JP)

(72) Inventors: Tomoko Nakagawa, Niigata (JP); Akihiko Yanagibori, Niigata (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/054,965

(22) Filed: Feb. 26, 2016

(65) Prior Publication Data

US 2016/0179025 A1 Jun. 23, 2016

Related U.S. Application Data

(63) Continuation of application No. PCT/JP2014/072828, filed on Aug. 29, 2014.

(30) Foreign Application Priority Data

Aug. 29, 2013 (JP) ..... 2013-178429
Mar. 13, 2014 (JP) ..... 2014-050705
Mar. 24, 2014 (JP) ..... 2014-060709

(51) Int. Cl.
*G03G 9/093* (2006.01)
*G03G 9/09* (2006.01)

(52) U.S. Cl.
CPC ..... *G03G 9/09314* (2013.01); *G03G 9/0904* (2013.01); *G03G 9/0935* (2013.01);
(Continued)

(58) Field of Classification Search
CPC ..... G03G 9/09314; G03G 9/09364; G03G 9/0935; G03G 9/09321; G03G 9/09392; G03G 9/0904
See application file for complete search history.

(56) References Cited

U.S. PATENT DOCUMENTS 5,296,266 A 3/1994 Kunugi et al.
2008/0063970 A1* 3/2008 Kikawa ..... G03G 9/09307 430/110.2

(Continued)

FOREIGN PATENT DOCUMENTS

JP 59-170852 9/1984
JP 2-61651 3/1990

(Continued)

OTHER PUBLICATIONS

International Search Report issued Oct. 7, 2014 in PCT/JP2014/072828 filed Aug. 29, 2014 (with English translation).

(Continued)

*Primary Examiner* — Stewart Fraser
(74) *Attorney, Agent, or Firm* — Oblon, McClelland, Maier & Neustadt, L.L.P.

(57) ABSTRACT

The object of the present invention is to provide an electrostatic image developing toner excellent in providing high image quality and excellent in low-temperature fixation performance and environmental stability. The present invention is an electrostatic image developing toner having a toner base particle containing at least a binder resin and a colorant, and an external additive, wherein the toner base particle has a core-shell structure having a core particle and a shell layer, the toner base particle has a resin coating layer of a water-soluble resin on the surface of the core particle, and has the shell layer on the resin coating layer.

10 Claims, 7 Drawing Sheets

(52) U.S. Cl.
CPC ..... *G03G 9/09321* (2013.01); *G03G 9/09364* (2013.01); *G03G 9/09392* (2013.01)

(56) References Cited

U.S. PATENT DOCUMENTS

| | | | | |
|---|---|---|---|---|
| 2009/0246669 | A1 | 10/2009 | Uno | |
| 2012/0040285 | A1* | 2/2012 | Shibata | G03G 9/09328 430/110.2 |
| 2013/0011775 | A1 | 1/2013 | Itou et al. | |
| 2013/0130171 | A1 | 5/2013 | Watanabe et al. | |
| 2013/0164666 | A1 | 6/2013 | Abe | |

FOREIGN PATENT DOCUMENTS

| | | |
|---|---|---|
| JP | 4-211269 | 8/1992 |
| JP | 2003-91093 | 3/2003 |
| JP | 2005-91811 | 4/2005 |
| JP | 2005-274964 | 10/2005 |
| JP | 2007-212871 | 8/2007 |
| JP | 2009-244494 | 10/2009 |
| JP | 2010-145555 | 7/2010 |
| JP | 2011-17807 | 1/2011 |
| JP | 2012-98714 | 5/2012 |
| JP | 2012-215859 | 11/2012 |
| JP | 2013-8026 | 1/2013 |
| JP | 2013-19972 | 1/2013 |
| JP | 2013-109142 | 6/2013 |
| JP | 2013-109326 | 6/2013 |

OTHER PUBLICATIONS

Written Opinion issued Oct. 7, 2014 in PCT/JP2014/072828 filed Aug. 29, 2014.

* cited by examiner

ELECTROSTATIC IMAGE DEVELOPING TONER

TECHNICAL FIELD

The present invention relates to an electrostatic image developing toner excellent in high-imaging quality, low-temperature fixation performance and blocking resistance.

BACKGROUND ART

An electrostatic image developing toner is used in image formation of visualizing electrostatic images in printers, copiers, facsimiles, etc. An example of image formation through electrophotography is referred to, in which an electrostatic latent image is first formed on a photoreceptor drum, and then this is developed with a toner, transferred onto transfer paper or the like, and fixed by heat or the like for image formation thereon.

As an electrostatic image developing toner, in general, used is one having such a form that is prepared by adhering an external additive of, for example, solid fine particles of silica or the like to the surfaces of toner particles obtained according to a so-called melt-kneading and grinding method that includes dry-mixing a binder resin and a colorant and optionally an electrification control agent, a release agent, a magnetic substance and the like, then melt-kneading them in an extruder or the like, and thereafter grinding and classifying the resultant substance, for the purpose of giving various properties such as flowability and the like to the toner particles.

Recently, in image formation in copiers, printers and the like, it has become desired to provide high-definition high-quality images, and there have been proposed various polymerization methods such as a suspension polymerization method, an emulsion aggregation method, a dissolution suspension method, etc., which easily controls the particle size of toner particles and the particle size distribution.

Further, with the recent popularization of copiers, printers and the like a toner has become desired that is excellent especially in high-speed printing performance and low-energy fixation capability in addition to the requirement to image quality, and improvement of low-temperature fixation performance of toner has been tried. For attaining low-temperature fixation, much used are a method of lowering the glass transition point of a binder resin, and a method of additionally using a crystalline resin, but low-temperature fixation performance and blocking resistance or hot offset resistance are contradictory to each other, in general and it is desired to satisfy both the two.

Regarding these problems, there has been tried a method of maintaining blocking resistance of toner while maintaining low-temperature fixation performance thereof, by employing a core-shell structure in which a shell layer having a high glass transition temperature (Tg) and excellent in heat resistance is formed around the surface of a core formed of a resin excellent in low-temperature fixation performance and having a low melt viscosity.

It is known that, in forming a core-shell structure, when a method of heating the structure at a high temperature after shell particles have been adhered thereto is employed, the shell particles are buried simultaneously with advance of fusion of core particles and shell particles and, as a result, there may form a non-coated part to cause insufficient blocking resistance. In addition, it is also known that, when the shell component is too large, the low-temperature fixation performance of toner would be thereby disturbed, but on the contrary, when the shell component is too small, a non-coated part may form and the core component may be thereby exposed to the toner surface, and therefore, the expected blocking resistance performance could not be obtained.

PTL 1 has tried satisfying both low-temperature fixation performance and cleaning performance, in which the core mainly contains a crystalline resin, the shell accounts for from 15% by mass to 120% by mass, more preferably from 25 to 100% by mass, even more preferably from 35 to 80% by mass relative to the core, and the shell has semispherical projections having a height difference of 0.3 μm or more. PTL 2 has tried satisfying both fixation capability and heat resistance, in which an interlayer containing inorganic fine particles or organic fine particles is formed on the surface of the inner core particle of toner and an outer shell layer is formed around the surface of the layer. PTL 3 has tried satisfying both low-temperature fixation performance and heat resistance storability by providing core-shell particles in which the core particle is surrounded by a shall layer composed of a resin particle layer A for securing heat resistance storability and a resin particle layer B existing around the layer A for securing emulsion stability. PTL 4 has tried evenly adhering an electrification control agent or an electrification control resin to the surface of a toner by making the surfaces of mother particles hold a positively-charging compound therearound and further firmly fixing a negative electrification control resin fine particles around the surfaces thereof.

CITATION LIST

Patent Literature

PTL 1: JP-A 2005-274964
PTL 2: JP-A 2003-91093
PTL 3: JP-A 2013-109142
PTL 4: JP-A 2009-244494

SUMMARY OF INVENTION

Technical Problem

However, PTL 1 says that a condition for adhering to the core, aggregates of shell-forming resin fine particles as a shell thereon is preferred, and from the necessity of entirely coating the entire surface of the core, as a result, it may be presumed that the ratio of the shell to the core is defined high, but as described below, when the ratio of the shell to the core is increased, the low-temperature fixation performance that the core has would be lose disadvantageously.

PTL 2 shows examples of using a benzoguanamine resin and tricalcium phosphate in the interlayer, in which, however, the nonflexible component contained in the interlayer is disadvantageous for attaining low-temperature fixation performance as known from the comparative examples to be mentioned below.

In PTL 3, the resin particle layer A and the resin particle layer B are needed both in such an amount enough to coat the core particles, and therefore the ratio of the total amount of the shell tends to increase relative to the core, but as described below, when the ratio of the shell relative to the core increases, the low-temperature fixation performance that the core has is disadvantageously lost.

In PTL 4, it is necessary that there is little difference between the glass transition temperature of the mother particles corresponding to core particles and the glass transition temperature of negative electrification control resin fine particles corresponding to shell particles, which is disadvantageous for satisfying both good low-temperature fixation performance and blocking resistance.

The present invention has been made in consideration of the above-mentioned problems, and is to provide an electrostatic image developing toner excellent in providing good image quality and capable of satisfying both low-temperature fixation performance and blocking resistance.

Solution to Problem

The present inventors have considered that the form most effective for satisfying both low-temperature fixation performance and blocking resistance is a form where the surfaces of core particles having low-temperature fixation performance are coated thinly with shell particles at a high coating ratio and where the shell particles can stay easily on the surfaces of the core particles, and as a means for the solution, the inventors have found that shell particles can be uniformly, thinly and densely coated with core particles as the interlayer by providing a resin coating layer of a water-soluble resin on the surfaces of the core particles.

The present invention has been based on the above-mentioned findings, and the gist of the present invention is as follows.

<1> An electrostatic image developing toner comprising a toner base particle containing at least a binder resin and a colorant, and an external additive, wherein:

the toner base particle has a core-shell structure having a core particle and a shell layer, the toner base particle has a resin coating layer of a water-soluble resin on the surface of the core particle, and has the shell layer on the resin coating layer, and the shell layer is formed of a particle comprising a resin as a main ingredient, and when a glass transition temperature of a polymer primary particle to constitute the core particle is referred to as Tg1, and a glass transition temperature of the particle to constitute the shell layer is referred to as Tg2, the Tg1 and Tg2 satisfy the following relationship:

$$25^\circ\ C. \leq Tg1 \leq 45^\circ\ C.$$

$$55^\circ\ C. \leq Tg2$$

$$Tg2 - Tg1 \geq 20$$

<2> The electrostatic image developing toner according to <1>, wherein the particle to constitute the shell layer contains a resin having a sulfonic acid group.

<3> The electrostatic image developing toner according to <1> or <2>, wherein the core particle is obtained according to a polymerization method.

<4> The electrostatic image developing toner according to any of <1> to <3>, wherein charging properties of the core particle and the resin coating layer are in an opposite relationship to each other, and wherein charging properties of the resin coating layer and the shell layer are in an opposite relationship to each other.

<5> The electrostatic image developing toner according to any of <1> to <4>, wherein the core particle has a capsule structure.

<6> The electrostatic image developing toner according to any of <1> to <5>, wherein a wax contained in the core layer of the core particle having a capsule structure is a wax where the time until the weight loss thereof at 200° C., as measured with a thermogravimetric analyzer, reaches 0.1%, is 15 minutes or more, and wherein a melting point of a wax contained in the shell layer of the core particle having a capsule structure is 70° C. or higher.

<7> The electrostatic image developing toner according to any of <1> to <6>, wherein the toner base particle is obtained through a process comprising mixing a dispersion of the core particles with an aqueous solution containing the water-soluble resin to adhere the water-soluble resin to the surface of the core particle, and further mixing therein a dispersion of particles to constitute the shell layer to adhere the particles to constitute the shell layer.

<8> The electrostatic image developing toner according to any of <1> to <6>, wherein the toner base particle is obtained through a process comprising mixing a dispersion of the core particles with an aqueous solution containing a water-soluble resin that has a charging property opposite to that of the core particles to adhere the water-soluble resin to the surface of the core particle and further mixing therein a dispersion of particles to constitute the shell layer that has a charging property opposite to that of the water-soluble resin to adhere the particles to constitute the shell layer.

Advantageous Effects of Invention

According to the present invention, there is provided an electrostatic image developing toner capable of satisfying both low-temperature fixation performance and blocking resistance.

The effects can be attained by arranging a resin coating layer of a water-soluble resin on the surface of a core particle having low-temperature fixation performance, and then coating the core particle with a shell particles having high blocking resistance at a high coating rate. The novel core-shell structure realizes more effective low-temperature fixation performance.

DESCRIPTION OF EMBODIMENTS

Figure 1:
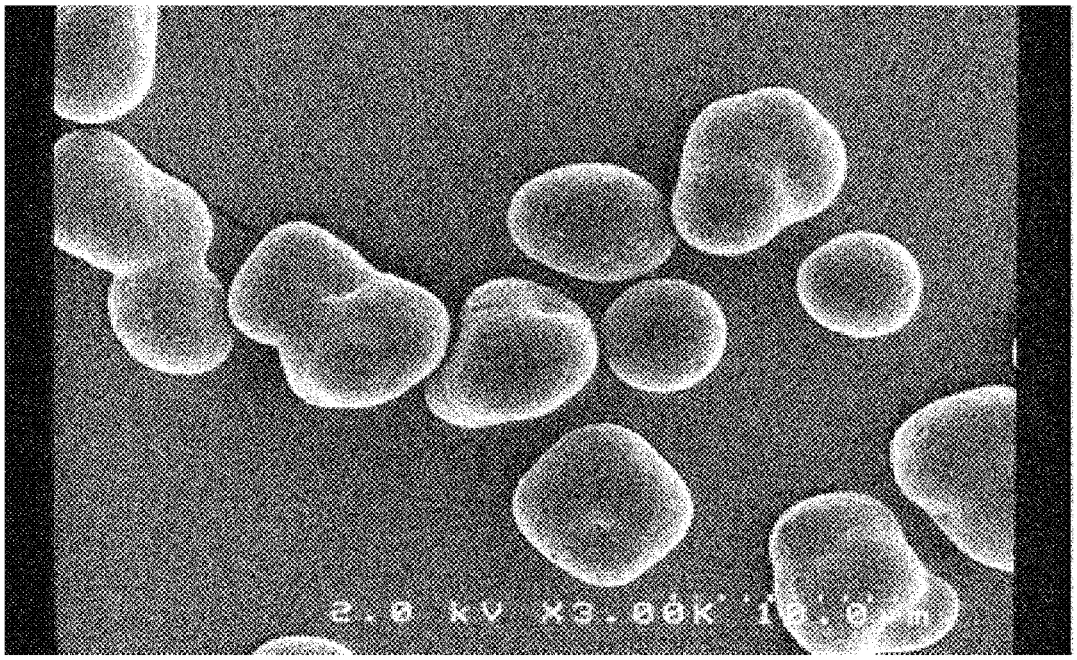
FIG. 1 is a 3000-power SEM picture of core particles in Example 8.

In the present invention, those in a state not as yet having a resin coating layer of a water-soluble resin and a shell layer are referred to as core particles. Those produced by forming a resin-coating layer of a water-soluble resin on the surfaces of the core particles and further forming a shell layer thereon, but not as yet containing an external additive are referred to as toner base particles. One having an external additive on the surfaces of the toner base particles is referred to as a toner. Here, in the present description, "% by mass" and "% by weight", and also "part by mass" and "part by weight" have the same meaning.

The toner of the present invention contains at least a binder resin and a colorant, and may optionally contain a wax, an electrification control agent, etc.

<1. Core Particle>

(1-1. Configuration of Core Particle)

The core particle contains at least a binder resin and a colorant, and may optionally contain a wax, an electrification control agent, etc.

Not specifically limited, the binder resin may be any one generally usable as a binder resin in producing a toner, and includes, for example, thermoplastic resins such as polystyrene resins, poly(meth)acrylic resins, polyolefin resins, epoxy resins, polyester resins, etc., and mixtures of these resins, etc.

As the monomer component to produce the binder resin, a monomer generally used in producing a binder resin for toner is appropriately usable.

For example, any polymerizing monomer including an acid group-having polymerizing monomer (hereinafter this may be simply referred to as acidic monomer), a basic group-having polymerizing monomer (hereinafter this may be simply referred to as basic monomer), and a polymerizing monomer having neither an acid group nor a basic group (hereinafter this may be referred to as other monomer).

In a case where a polystyrene copolymer resin and a poly(meth)acrylic resin is used as the binder resin, the following monomers are exemplified for the resin.

As the acidic monomer, there are mentioned a carboxyl group-having polymerizing monomer such as acrylic acid, methacrylic acid, maleic acid, fumaric acid, cinnamic acid, etc.; a sulfonic acid group-having polymerizing monomer such as sulfonated styrene, etc.; a sulfonamide group-having polymerizing monomer such as vinylbenzenesulfonamide, etc.

As the basic monomer, there are mentioned an amino group-having aromatic vinyl compound such as aminostyrene, etc.; a nitrogen-containing heterocyclic group-containing polymerizing monomer such as vinylpyridine, vinylpyrrolidone, etc.; an amino group-having (meth)acrylate such as dimethylaminoethyl acrylate, diethylaminoethyl methacrylate, etc.

These acidic monomer and basic monomer contribute toward dispersion stabilization of the core particles. One alone or plural types of these may be used either singly or as combined, and these may exist as salts each accompanied by a counter ion.

As the other monomer, there are mentioned styrenes such as styrene, methylstyrene, chlorostyrene, dicholorostyrene, p-t-butylstyrene, p-n-butylstyrene, p-n-nonylstyrene, etc.; acrylates such as methyl acrylate, ethyl acrylate, propyl acrylate, n-butyl acrylate, isobutyl acrylate, hydroxyethyl acrylate, 2-ethylhexyl acrylate, etc.; methacrylates such as methyl methacrylate, ethyl methacrylate, propyl methacrylate, n-butyl methacrylate, isobutyl methacrylate, hydroxyethyl methacrylate, 2-ethylhexyl methacrylate, etc.; acrylamide, N-propylacrylamide, N,N-dimethylacrylamide, N,N-dipropylacrylamide, N,N-dibutylacrylamide, etc. One alone or plural types of the other monomers may be used either singly or as combined.

In a case where the binder resin is a crosslinked resin, a polyfunctional monomer is used along with the above-mentioned polymerizing monomer, and examples thereof include divinylbenzene, hexanediol diacrylate, ethylene glycol dimethacrylate, diethylene glycol dimethacrylate, triethylene glycol dimethacrylate, tetraethylene glycol dimethacrylate, hexamethylene glycol dimethacrylate, nonaethylene glycol dimethacrylate, diethylene glycol diacrylate, triethylene glycol diacrylate, neopentylglycol dimethacrylate, neopentylglycol diacrylate, diallyl phthalate, etc.

Above all, a difunctional polymerizing monomer is preferred, and divinylbenzene and hexancdiol diacrylate are especially preferred. One alone or plural types of these polyfunctional polymerizing monomers may be used either singly or as combined.

A polymerizing monomer having a reactive group in the pendant group thereof, for example, glycidyl methacrylate, methylolacrylamide, acrolein or the like may also be used.

If desired, a known chain transfer agent may be used. Specific examples of the chain transfer agent include t-dodecylmercaptan, dodecanethiol, diisopropyl xanthate, carbon tetrachloride, trichlorobromomethane, etc. One alone or plural types of the chain transfer agent may be used either singly or as combined, and the agent may be used in an amount of from 0 to 5% by weight relative to the polymerizing monomer.

In a case where a polystyrene copolymer resin and a poly(meth)acrylic resin are sued as the binder resin, the number-average molecular weight thereof through gel permeation chromatography (hereinafter referred to as GPC) is preferably 2000 or more, more preferably 2500 or more, even more preferably 3000 or more, and is preferably 50,000 or less, more preferably 40,000 or less, even more preferably 35,000 or less. The weight-average molecular weight of the resin, measured in the same manner, is preferably 20,000 or more, more preferably 30,000 or more and is preferably 500,000 or less, more preferably 450,000 or less. The toner whose number-average molecular weight and weight-average molecular weight of the binder resin each fall within the above-mentioned range is preferred as securing good durability, storability and fixation performance of the toner.

In a case where a polyester resin is used as the binder resin, the dialcohol for the resin includes, for example, diols such as ethylene glycol, diethylene glycol, triethylene glycol, 1,2-propylene glycol, 1,3-propylene glycol, 1,4-butanediol, neopentylglycol, 1,4-butenediol, 1,5-pentanediol, 1,6-hexanediol, etc.; bisphenol A, hydrogenated bisphenol A; bisphenol A alkylene oxide adducts such as polyoxyethylenated bisphenol A, polyoxypropylenated bisphenol A, etc.; and the diacid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid; anhydrides and lower alkyl esters of these acids; alkenylsuccinic acids and alkylsuccinic acids such as n-dodecenylsuccinic acid, n-dodecylsuccinic acid, etc.; and other organic diacids.

In a case where the binder resin is a crosslinked resin, a polyfunctional monomer is used along with the above-mentioned polymerizing monomer, including, for example, tri- or more polyalcohols such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc. Examples of tri- or more polyacids include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, their anhydrides, etc.

These polyester resins may be synthetized in an ordinary method. Concretely, the conditions of reaction temperature (170 to 250° C.), reaction pressure (5 mmHg to normal pressure) and others may be determined according to the reactivity of the monomer, and when desired physical properties are attained, the reaction may be finished.

In a case where a polyester resin is used as the binder resin, the number-average molecular weight thereof in GPC is preferably from 2000 to 20000, more preferably 3000 to 12000.

The glass transition temperature (Tg) of the binder resin is not specifically limited so far as it falls within a range not detracting the advantageous effects of the present invention, but is preferably 30° C. or higher and preferably 80° C. or lower, more preferably 60° C. or lower, even more preferably 55° C. or lower.

Wax may be used as an offset inhibitor. Low-temperature fixation performance and blocking resistance or hot offset resistance are contradictory to each other, and for satisfying both the two, it is desirable to make the toner has a core/shell structure and, in addition, to use wax as an offset inhibitor.

For improving low-temperature fixation performance, wax may also be used.

The wax for use in the toner of the present invention may be any known wax, concretely including olefinic waxes such as low-molecular-weight polyethylene, low-molecular-weight polypropylene, copolymer polyethylene, etc.; paraffin waxes; long chain aliphatic group-having ester waxes such as behenyl behenate, montanates, stearyl stearate, etc.; hydrogenated castor oil; vegetable waxes such as carnauba wax, etc.; long chain alkyl group-having ketones such as distearyl ketone, etc.; alkyl group-having silicones; higher fatty acids such as stearic acid, etc.; long chain fatty acid alcohols; long chain fatty acid polyalcohols such as pentaerythritol, etc., and partial esters thereof; higher fatty acid amides such as oleic acid amide, stearic acid amide, etc. Preferred are hydrocarbon waxes such as paraffin wax, Fischer-Tropsch wax, etc., and ester waxes and silicone waxes. One alone or two or more of waxes may be used either singly or as combined.

In driving printers, etc., ultrafine particles are discharged from devices along with ozone, dust and VOC. It is considered that ultrafine particles would be formed by vaporizing chemical substances from toners, fixation members, paper and the like participating in a fixation process, and rapidly cooling them into particles. As one method for reducing ultrafine particles, it is effective to select wax that may evaporate few chemical substances in fixation. For example, there are mentioned neopentyl polyol esters represented by the following general formula (1).

[Chem. 1]

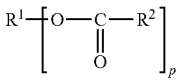

(1)

In the formula (1), $R^1$ represents a di to octahydric neopentyl polyol residue, $R^2$ represents a linear alkyl group having from 13 to 25 carbon atoms, and p indicates an integer of from 2 to 8.

Of the neopentyl polyol esters represented by the formula (1), preferred are waxes where the time until the weight loss thereof at 200° C., as measured with a thermogravimetric analyzer, reaches 0.1%, is 15 minutes or more. More preferred is a wax that takes 17 minutes or more for the arrival, even more preferably 19 minutes or more. In general, the temperature of the fixation roller in a printer is 200° C. or less, and in heating at 200° C., the amount of the vaporizing components is small. In other words, by selecting a wax whose weight loss speed is low, it is expected that the amount of the vaporizing components from the wax could be reduced at an actual fixation temperature in a printer. As a result, ultrafine particles could be reduced from being discharged during printer operation.

The melting point of the wax is preferably 120° C. or lower, more preferably 110° C. or lower, even more preferably 100° C. or lower, and is preferably 40° C. or higher, more preferably 50° C. or higher. When the melting point is too high, the effect of lowering the fixation temperature would be poor. When the melting point is too low, there may occur some problems in blocking resistance and storability.

Preferably, the amount of the wax is 1 part by mass or more relative to 100 parts by mass of the toner, more preferably 2 parts by mass or more, even more preferably 5 parts by mass or more. Also preferably, the amount is 40 parts by mass or less, more preferably 35 parts by mass or less, even more preferably 30 parts by mass or less. When the wax content in the toner is too small, the performance such as hot offset resistance would not be sufficient, but when too much, blocking resistance would be insufficient or the wax may be released from the toner to stain devices.

As the colorant, any known colorant may be used in any desired manner. Specific examples of the colorant include carbon black, aniline blue, phthalocyanine blue, phthalocyanine green, Hansa yellow, rhodamine pigments, chrome yellow, quinacridone, benzidine yellow, rose bengal, triallylmethane dyes, monoazo, disazo and condensed azo dyes and pigments, etc., and these known dyes and pigments may be used either singly or as combined. In a full color toner, preferred are benzidine yellow, monoazo or condensed azo dyes or pigments for yellow, quinacridone and monoazo dyes or pigments for magenta, and phthalocyanine blue for cyan. Preferably, the colorant is used in an amount of 3 parts by mass or more and 20 parts by mass or less relative to 100 parts by mass of the toner.

Any known electrification control agent may be used in any desired manner. Specific examples of the electrification control agent include nigrosine dyes, amino group-containing vinyl copolymers, quaternary ammonium salt compounds, polyamine resins and the like for positive electrification, and metal-containing azo pigments containing a metal such as chromium, zinc, iron, cobalt, aluminium or the like, and salts and metal complexes of salicylic acid or alkylsalicylic acid with the metal and the like for negative electrification. The amount of the electrification control agent is preferably from 0.1 to 25 parts by mass relative to 100 parts by mass of the toner, more preferably from 1 to 15 parts by mass. The electrification control agent may be used in the form thereof incorporated in the core particles, or adhered to the surface of the toner base particles.

(1-2. Formation Method for Core Particles)

Not specifically limited, the core particles in the present invention may be produced in any known method.

(1-2-1. Method for Formation of Core Particles by Aggregating Particles Smaller than Core Particle Size)

Each source material is prepared as particles having a size smaller than the core particle size, and these particles are mixed and aggregated to give the core particles. This method is employable.

For preparing a dispersion of a polymer primary particle having a diameter smaller than the core particle size using a binder, some methods are mentioned below.

(1-2-1-1. Emulsion Polymerization)

Polymer primary particles with a styrenic or (meth)acrylic monomer as the constituent element may be obtained through emulsion polymerization of the above-mentioned styrenic or (meth)acrylic monomer optionally along with a chain transfer agent, using an emulsifying agent.

A known emulsifying agent is usable, and one or more emulsifying agent selected from cationic surfactants, anionic surfactants and nonionic surfactants may be used either singly or as combined.

Examples of the cationic surfactants include dodecylammonium chloride, dodecylammonium bromide, dodecyltrimethylammonium bromide, dodecylpyridinium chloride, dodecylpyridinium bromide, hexadecyltrimethylammonium bromide, etc.; examples of the anionic surfactants include fatty acid soaps such as sodium stearate, sodium decanoate, etc.; and sodium dodecylsulfate, sodium dodecylbenzenesulfonate, sodium laurylsulfate, etc. Examples of the nonionic surfactants include polyoxyethylene dodecyl ether, polyoxyethylene hexadecyl ether, polyoxyethylene nonylphenyl ether, polyoxyethylene lauryl ether, polyoxyethylene sorbitan monooleate ether, monodecanoylsucrose, etc.

The amount of the emulsifying agent to be used is preferably from 0.1 parts by mass to 10 parts by mass relative to 100 parts by mass of the polymerizing monomer. Along with the emulsifying agent, for example, usable together are one or more of polyvinyl alcohols such as partially or completely saponified polyvinyl alcohol as a protective colloid, etc., cellulose derivatives such as hydroxyethyl cellulose, etc., as a protective colloid.

Also if desired, one or more known polymerization initiators may be used either singly or as combined. For example, persulfate salts such as potassium persulfate, sodium persulfate, ammonium persulfate, etc.; redox initiators containing the persulfate salt as one component combined with a reducing agent such as acidic sodium sulfite, etc.; water-soluble polymerization initiators such as hydrogen peroxide, 4,4'-azobiscyanovaleric acid, t-butyl hydroperoxide, cumene hydroperoxide, etc.; as well as redox initiators containing the water-soluble initiator as one component combined with a reducing agent such as a ferrous salt, etc.; benzoyl peroxide, 2,2'-azobisisobutyronitrile, etc. The polymerization initiator may be added to the polymerization system at any time before or after or simultaneously with addition of a polymerizing monomer thereto, and if desired, these addition methods may be combined.

For dispersing wax in the toner to have a suitable dispersed particle size, preferably employed is so-called seed polymerization of adding wax as a seed in emulsion polymerization. Adding as a seed enables fine and uniform dispersion of wax in the toner, therefore preventing the charging property and the heat resistance of the toner from worsening.

Wax may be previously dispersed in an aqueous dispersion medium along with a long-chain polymerizing monomer such as stearyl acrylate or the like to prepare a wax/long-chain polymerizing monomer dispersion, the polymerizing monomer may be polymerized in the presence of the wax/long-chain polymerizing monomer.

A colorant may be added as a seed in the system of emulsion polymerization, but when a polymerizing monomer is polymerized in the presence of a colorant, the metal in the colorant would have some influence on radical polymerization so that the molecular weight or rheology control of resin would be difficult and desired physical properties could not be obtained. Therefore, it is desirable that a colorant is not added during emulsion polymerization and a colorant dispersion is added in the next step.

(1-2-1-2. Method for Emulsification of Resin)

A resin is obtained according to a method of bulk polymerization, solution polymerization, suspension polymerization, emulsion polymerization or the like, then mixed with an aqueous medium, and heated at a temperature higher than any of the melting point or the glass transition temperature of the resin to lower the viscosity of the resin, and thereafter shearing force is given thereto to perform emulsifying, thereby providing polymer primary particles.

The emulsifying machine for imparting shearing force includes, for example, a homogenizer, a homomixer, a pressure kneader, an extruder, a media disperser, etc.

In a case where the viscosity of the resin is high in emulsion so that the resin could not be dispersed into particles having a desired particle size, the temperature of the resin may be elevated using an emulsifying device capable of pressuring the system up to an atmospheric pressure or higher, and in a state where the resin viscosity has been lowered, the resin may be emulsified to give polymer primary particles having a desired particle size.

Another method is also employable where an organic solvent is previously mixed with resin to lower the viscosity of the resin. The usable organic solvent is not specifically limited so far as it can dissolve resin. Ketone solvents such as tetrahydrofuran (THF), methyl acetate, ethyl acetate, methyl ethyl ketone, etc., and benzene solvents such as benzene, toluene, xylene, etc. can be used. Further, for improving the affinity with an aqueous medium and for controlling the particle size distribution, al alcohol solvent such as ethanol, isopropyl alcohol or the like may be added to water or resin. In a case where an organic solvent is added, the organic solvent must be removed from the resultant emulsion after emulsification. For removing the organic solvent, a method of vaporizing the organic solvent at room temperature or with heating under reduced pressure is employable.

For the purpose of controlling the particle size distribution, a salt such as sodium chloride or potassium chloride, or ammonia, etc. may be added.

For the purpose of controlling the particle size distribution, an emulsifying agent or a dispersant may be added. For example, there are mentioned water-soluble polymers such as polyvinyl alcohol, methyl cellulose, carboxymethyl cellulose, sodium polyacrylate, etc.; the above-mentioned emulsifying agents; inorganic compounds such as tricalcium phosphate, aluminium hydroxide, calcium sulfate, calcium carbonate, barium carbonate, etc. The amount of the agent to be used is preferably from 0.01 to 20 parts by mass relative to 100 parts by mass of resin.

When a resin containing an acidic group or a basic group is used, the amount of the emulsifying agent and the dispersant to be added may be reduced, but in the case, the moisture absorbability of the resin may increase and the charging property thereof may worsen.

A phase inversion emulsification method may also be employable. The phase inversion emulsification method is a method of obtaining an emulsion by optionally adding an organic solvent, a neutralizing agent and a dispersion stabilizer to resin, stirring them, dropwise adding an aqueous medium thereto to give emulsified particles, and removing the organic solvent from the resin dispersion to give an emulsion. As the organic solvent, a same one as the above-mentioned organic solvent may be used. As the neutralizing agent, an ordinary acid or alkali such as nitric acid, hydrochloric acid, sodium hydroxide, ammonia or the like may be used.

(1-2-1-3. Formation of Core Particles)

In any preparation method of the above-mentioned emulsion polymerization or resin emulsification, the volume-average particle size of the resultant polymer primary particles is generally 0.02 μm or more, preferably 0.05 μm or more, more preferably 0.1 μM or more, and is generally 3 μm or less, preferably 2 μm or less, more preferably 1 μm or less. When the volume-average particle size of the polymer primary particles is smaller than the above-mentioned range, the aggregation rate in the aggregation step would be difficult to control. On the other hand, when the size is larger than the range, the particle size of the core particles to be obtained through aggregation would be readily too large and it would be often difficult to obtain core particles having an intended particle size.

In any preparation method, Tg of the polymer primary particles is from 25° C. to 45° C.

In the aggregation step, the components to be compounded such as the above-mentioned polymer primary particles, colorant particles and other optional ingredients of electrification control agent, wax and the like are mixed simultaneously or successively. From the viewpoint of composition uniformity and particle size uniformity, it is desirable that dispersions of the respective ingredients, that is a dispersion of polymer primary particles, a dispersion of colorant particles, and optionally an electrification control agent dispersion, a dispersion of wax fine particles and the like are previously prepared, and these are mixed to give a mixed dispersion.

Preferably, the colorant is used as a dispersion in water in the presence of an emulsifying agent, and preferably, the volume-average particle size of the colorant particles is 0.01 μm or more, more preferably 0.05 μm or more, and is preferably 3 μm or less, more preferably 1 μm or less.

In the emulsion aggregation method, in general, the aggregation is carried out in a tank equipped with a stirrer, and the method includes a heating method, an electrolyte-adding method and a method of combining these. In a case where polymer primary particles are aggregated with stirring to give aggregate particles having an intended size, the particle size of the aggregate particles would be controlled by the balance between the cohesion force of the particles and the shearing force by stirring, but by heating or by adding an electrolyte, the cohesion force may be increased.

The electrolyte in the case where aggregation is conducted by electrolyte addition may be any of acids, alkalis and salts, and may be any of organic or inorganic substances. Concretely, the acids include hydrochloric acid, nitric acid, citric acid, etc.; the alkalis include sodium hydroxide, potassium hydroxide, aqueous ammonia, etc.; the salts include NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, $C_6H_5SO_3Na$, etc. Of those, preferred are inorganic salts having a divalent or more polyvalent metal cation.

The amount of the electrolyte to be added may vary depending on the type of the electrolyte, the intended particle size and the like, but is preferably 0.02 parts by mass or more relative to 100 parts by mass of the solid component of the mixed dispersion, more preferably 0.05 parts by mass or more. Also preferably 25 parts by mass or less, more preferably 15 parts by mass or less, even more preferably 10 parts by mass or less. When the amount added is too small, there may occur some problems in that the aggregation rate would be slow so that fine particles of 1 μm or smaller may remain even after aggregation or the mean particle size of the resultant aggregate particles would not reach the intended level; but when too large, there may occur other problems in that the aggregation speed would be too rapid so that the particle size control would be difficult and the resulting aggregate particles may contain coarse particles or amorphous matter. The aggregation temperature in the case where the aggregation is conducted with electrolyte addition may be 20° C. or higher, more preferably 30° C. or higher, and may by 80° C. or lower, more preferably 70° C. or lower.

The time for aggregation may be optimized by the device configuration and the processing scale, and in order that the particle size of the core particles could reach the intended particle size level, it is desirable that the system is kept at the above-mentioned predetermined temperature generally for at least 30 minutes or more. Regarding the heating profile until the system could reach the predetermined temperature, the system may be heated at a constant rate or may be heated in a stepwise heating mode.

Not forming the aggregate particles by mixing all the material dispersions first at once but forming aggregate particles by mixing a part of the material dispersions followed by adding the remaining material dispersions thereto could make a difference in the composition between the inside and the surface of the core particles. The material dispersions to be added later may be the same as or may differ from those added first. Specifically, the core particles themselves may have a so-called capsule structure. Concretely, in a case where the particle constituting the core layer of the core particle having a capsule structure is referred to as a core particle c and the particle constituting the shell layer of the core particle having a capsule structure is referred to as a shell particle s, aggregate particles are formed of the core particles c, then the shell particles s are added thereto and fused, and through the process, core particles having a capsule structure are obtained.

For example, in a case where polymer primary particles (corresponding to the shell particles s) having a higher Tg than the polymer primary particles first mixed (corresponding to the core particles c) are added, in the following ripening step, the configuration of the resultant particles could not be such that the added particles penetrate into the surface of the particle and the surface is completely covered with the added particles, but the configuration of the resultant core particles could be such that in the inside thereof, the ratio of the resin having a lower Tg is high and in the surface, the ratio of the resin having a higher Tg is high. In the present invention, the blocking resistance is enhanced by coating the shell particles to form the shell layer according to the method described hereinunder in the section of (3. Shell Layer), and when the method of forming the core particles to have a capsule structure is combined, further better blocking resistance could be realized more easily.

In the case of forming the core particles having a capsule structure, the wax to be contained in the source material to be mixed first may be made to differ from the wax to be contained in the source material to be mixed later, whereby the wax inside the core particle may differ from the wax in the surface thereof.

In this case, it is desirable that the wax to be contained in the source material to be mixed first is so selected as to be one well miscible with resin and that the wax to be contained in the additional source material is so selected as to be one poorly miscible with resin.

The wax highly miscible with resin lowers the viscosity of resin during heating for fixation to thereby enhance low-temperature fixation performance.

On the other hand, the wax poorly miscible with resin dissolves out from the toner through fusion during heating for fixation to thereby exhibit a release effect and contribute toward hot offset resistance. By arranging the wax in the position close to the toner surface, the release effect thereof could be efficiently exhibited.

The miscibility between resin and wax can be presumed from the free energy change in polymer mixing, and concretely can be defined by the difference in the solubility parameter between the constituent resin and the wax and by the molecular weight of the wax. Specifically, when the value of the solubility parameter of the wax to be used is closer to that of the constituent resin, or when the molecular weight of the resin is smaller, it is considered that the miscibility could be good. On the other hand, in a case where the wax includes different types of chemical species or when the crystallinity thereof is lowered owing to the impurities therein, the miscibility could not be presumed simply. In the case, the miscibility could be presumed by directly observing the dispersion particle size in the resin with TEM or the like, or from the degree of depression in Tg of the resin that contains the wax.

In the case of the corer particles having a capsule structure, it is desirable from the viewpoint of fixation performance that the wax contained in the shell layer, that is, contained outside the core particle differs from the wax contained in the core layer, that is, contained inside the core particle, and that the melting point of the wax contained outside is higher than the melting point of the wax contained inside. Preferably, the difference between the melting point of the wax contained outside and the melting point of the wax contained inside is 5° C. or more, and preferably, the upper limit thereof is 30° C. or less, more preferably 20° C. or less, even more preferably 15° C. or less.

In the case of the corer particles having a capsule structure, it is desirable that the wax contained in the core layer of the core particle is highly miscible with resin, that the wax contained in the shell layer of the core particle is poorly miscible with resin, and that the wax content in the core layer of the core particle is larger than the wax content in the shell layer of the core particle. Concretely, when the amount of the wax contained in the core layer of the core particle having a capsule structure is referred to as Wcc, and the amount of the wax contained in the shell layer of the core particle having a capsule structure is referred to as Wcs, Wcc/Wcs is preferably from 99/1 to 80/20, more preferably from 99/1 to 90/10.

In the case, it is also desirable the wax contained in the core layer of the core particle having a capsule structure is a wax where the time until the weight loss thereof at 200° C. reaches 0.1%, is 15 minutes or more. More preferred is a wax that takes 17 minutes or more for the arrival, even more preferably 19 minutes or more. When a wax having a small amount of volatiles is selected for the wax whose content is large, it is effective for reducing the discharge of ultrafine particles in printer operation. In this case, it is further desirable that the wax contained in the shell layer of the core particles is poorly miscible with the constituent resin as mentioned above and that the melting point thereof is 70° C. or higher.

The condition for adhering the additional particles to the aggregate particles is as follows.

The temperature is preferably not higher than Tg of the polymer primary particles in the aggregate particles and in the additional particles. In the case, the additional particles can readily adhere to the aggregate particles and, as a result, the resultant adhered particles can be readily stabilized. The processing time depends on the temperature and therefore could not be indiscriminately defined, but may be generally from 5 minutes to 2 hours or so. This operation may be conducted statically or with stirring with a mixer or the like. The latter is advantageous as enabling uniform adhesion of the additional particles.

The operation of adding the additional particles may be conducted once, or in plural times. The first additional particles and the subsequent additional particles may be in any combination, and may be suitably selected depending on the use and the object of the electrostatic image developing toner.

For enhancing the stability of the aggregate particles obtained in the aggregation step, it is desirable that the aggregate particles are fused inside them in the ripening step after the aggregation step. The temperature of the ripening step is preferably not lower than Tg of the polymer primary particles, more preferably higher than Tg by 5° C., and is preferably higher than Tg by 80° C., more preferably higher than Tg by 60° C. The time necessary for the ripening step varies depending on the shape of the intended core particles, but it is desirable that, after the particles have reached a temperature not lower than Tg of the polymer primary particles, they are kept as such for generally from 0.1 to 10 hours, preferably from 0.5 to 5 hours.

After the aggregation step, preferably before the ripening step or during the ripening step, it is desirable that a surfactant is added, or the pH is controlled, or the two are combined. The surfactant to be employed here may be one or more selected form the emulsifying agents usable in producing the polymer primary particles, but is preferably the same one as the emulsifying agent used in producing the polymer primary particles. The amount of the surfactant, if added, is not specifically limited, but is preferably 0.1 parts by mass or more relative to 100 parts by mass of the solid content of the mixed dispersion, more preferably 0.3 parts by mass or more, and is preferably 20 parts by mass or less, more preferably 15 parts by mass or less, even more preferably 10 parts by mass or less. After the aggregation step and before the finish of the ripening step, a surfactant is added or the pH is controlled whereby the aggregate particles obtained in the aggregation step can be prevented from further aggregating together and the formation of coarse particles after the ripening step can be thereby prevented.

The aggregate particles before the ripening step are considered to be aggregates formed through electrostatic or physical aggregation of the polymer primary particles, and after the ripening step, the polymer primary particles to constitute the aggregate particles fuse together. By controlling the temperature and the time in the ripening step, various core particles having different shapes depending on the purposes thereof, such as botryoidal particles formed through aggregation of the polymer primary particles, potato-like particles formed through advanced fusion, spherical particles formed through further advanced fusion and the like, can be produced.

(1-2-2. Method for Producing Particles Having Core Particle Size)

After the source materials have been mixed respectively, a method can be employed where the resultant mixture is particulated into particles having a core particle size to give core particles.

(1-2-2-1. Suspension Polymerization)

Additives such as a colorant, a polymerization initiator and optionally a wax, a polar resin, an electrification control agent, a crosslinking agent and the like are added to the above-mentioned styrenic or (meth)acrylic monomer, and uniformly dissolved or dispersed therein to prepare a monomer composition. The monomer composition is dispersed in an aqueous medium optionally containing a suspension stabilizer or the like. With controlling the stirring speed and time so that the liquid droplets of the monomer composition could have a size of the desired core particles, the composition is granulated. Subsequently, with stirring the system in such a degree that the granular state could be maintained and the particles could be prevented from precipitating owing to the effect of the dispersion stabilizer, the system is polymerized to give core particles.

Specific examples of the suspension stabilizer include calcium phosphate, magnesium phosphate, calcium hydroxide, magnesium hydroxide, etc. One alone or two or more of these may be used either singly or as combined, and preferably, the amount thereof is 1 part by mass or more and 10 parts by mass or less relative to 100 parts by mass of the polymerizing monomer. The suspension stabilizer may be added to the polymerization system in any stage before, during or after addition of the polymerizing monomer, and if desired, these addition methods may be combined.

In a case where the monomer composition contains a polar resin, the monomer composition is dispersed in an aqueous medium to form liquid droplets and then the polar resin can readily move in the vicinity of the surfaces of the liquid droplets. Polymerizing the system in the state gives core particles having a difference in the composition between the inside and the surface thereof. For example, when a polar resin having a higher Tg than Tg of the monomer after polymerization is selected, the resultant core particles may have a structure where Tg inside the core particle is low and the resin having a high Tg exists in a high ratio in the surface thereof. In the present invention, the blocking resistance is enhanced by coating the shell particles, and by combining the methods, better blocking resistance is easy to realize.

In addition, a pH regulator, a polymerization degree regulator, a defoaming agent and the like may be suitably added to the reaction system.

(1-2-2-2. Dissolution Suspension)

At least a binder resin and a colorant and optionally a wax, an electrification control agent and others are dissolved or dispersed in an organic solvent to prepare an oily dispersion, and this is dispersed in an aqueous medium. Next, the organic solvent is removed from the dispersion to give core particles.

The aqueous medium may be water alone, but a solvent miscible with water may be combined with water.

If desired, a dispersant may be used. Using a dispersant is preferred as capable of sharpening the particle size distribution and capable of stabilizing the dispersion. The dispersant may be the same one as the above-mentioned emulsifying agent for use in emulsion polymerization. Various types of hydrophilic polymer substances capable of forming polymer protective colloids in an aqueous medium can be made to exist in the system. Inorganic fine particles and/or polymer fine particles may also be used. As the inorganic fine particles, various types of known inorganic compounds that are insoluble or hardly soluble in water may be used. The compounds include tricalcium phosphate, calcium carbonate, titanium oxide, colloidal silica, hydroxyapatite, etc. As the polymer fine particles, various types of known ones that are insoluble or hardly soluble in water may be used.

In a case where the oily dispersion is dispersed in an aqueous medium, the dispersing devices to be used include known dispersers of low-speed shearing, high-speed shearing, frictional, high-pressure jet, ultrasonic or the like ones.

In place of the binder resin, a prepolymer having a reactive group may be used to prepare an oily dispersion, and this may be dispersed in an aqueous medium to elongate the resin through reaction with the reactive group. According to this method, the prepolymer has a relatively low molecular weight and therefore the viscosity of the oily dispersion is difficult to increase and the dispersion can be thereby easily dispersed in the aqueous medium.

For facilitating uniform dispersion of a colorant in the oily dispersion, a colorant may be formed into a composite with resin to prepare a master batch in advance, and this may be dispersed in an organic solvent.

For removing the organic solvent, a method of evaporating the organic solvent under reduced pressure at room temperature or with heating may be employed.

When a highly-polar resin and a poorly-polar resin is combined for use as the binder resin, and after the monomer composition is dispersed in an aqueous medium to form liquid drops, the highly-polar resin moves around the surface of the liquid drop while the poorly-polar resin moves around the center of the liquid drop. Subsequently, by removing the organic solvent, there can be obtained core particles having a difference in the composition between the inside and the surface thereof.

In a case where an oily dispersion is to be formed using a prepolymer reactive with an active hydrogen group-containing compound, an oily dispersion is dispersed in an aqueous medium, then an active hydrogen group-containing compound is added thereto, and the two are reacted for chain extension or for crosslinking from the surface of the liquid droplet in the aqueous medium, whereby a chain-extended or crosslinked resin is preferentially formed in the surface of the liquid droplet. Subsequently, the organic solvent is removed to give core particles having a difference in the composition between the inside and the surface thereof.

According to these methods, starting materials are selected in consideration of Tg to thereby give a structure in which a resin having a low Tg exists in the inside of the core particle at a high rate, while a resin having a high Tg exists in the surface thereof at a high rate.

Even when polymer fine particles having a high Tg are used as a dispersant, there can be obtained the same structure as above in which a resin having a low Tg exists in the inside of the core particle at a high rate while a resin having a high Tg exists in the surface thereof at a high rate.

In the present invention, by coating the shell particles, the blocking resistance is enhanced, and by combining these methods, better blocking resistance is easy to realize.

(1-2-3. Treatment of Resultant Core Particles)

In a case where core particles are formed according to a polymerization method such as an emulsion aggregation method, a suspension polymerization method, a dissolution suspension method or the like, the slurry liquid in production of the core particles are directly as it is, or after the dispersant, the emulsifying agent and others existing in the core particles dispersion are washed away in a range not forming aggregates of the core particles, used in the next step.

For the washing, for example, through filtration, decantation or the like, there may be employed a method where the core particles are separated from the aqueous medium containing the dispersant, the emulsifying agent and others through decantation or the like, and a fresh aqueous medium is added to the resultant core particles that are in the form of thick slurry or wet cake to disperse the particles therein, and this operation is repeated.

<2. Resin Coating Layer of Water-Soluble Resin>

In the toner of the present invention, a resin coating layer of a water-soluble resin (hereinafter this may be referred to as a water-soluble resin coating layer) is formed on the surface of the core particle. The water-soluble resin coating layer is to be a base for uniformly coating the core particle with shell particles to be the outermost surface of the resultant particles, and by inversely planning the charging property of the water-soluble resin coating layer and the shell particles, the shell particles could be made to adhere to every part of the surface of the water-soluble resin coating layer to form a thin and thick shell layer and, as a result, good blocking resistance can be realized without detracting from low-temperature fixation performance.

In the present invention, the resin coating layer of a water-soluble resin means a layer of a film having a substantially smooth surface though still having the surface irregularities originating in the surface irregularities of the core particles. The water-soluble resin coating layer may contain plural types of water-soluble resins not significantly detracting from the advantageous effects of the present invention. Here, water solubility means that the solubility of a substance in water at 25° C. is 1 g/100 ml or more.

Figure 2:
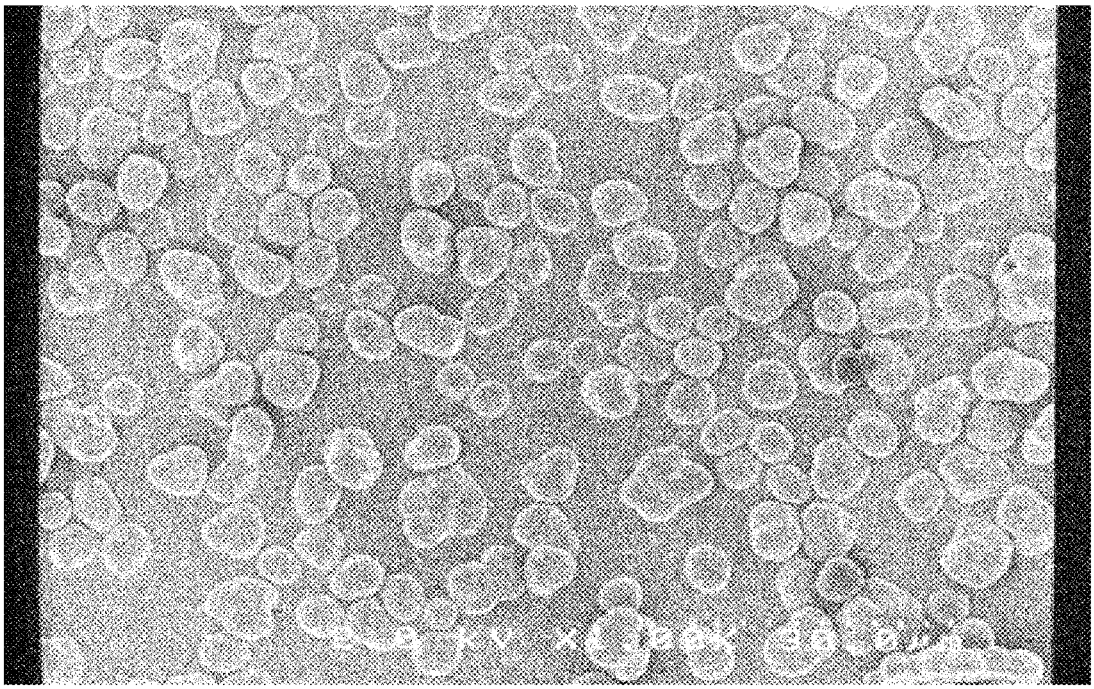
FIG. 2 is a 1000-power SEM picture of core particles in Example 8.
Figure 3:
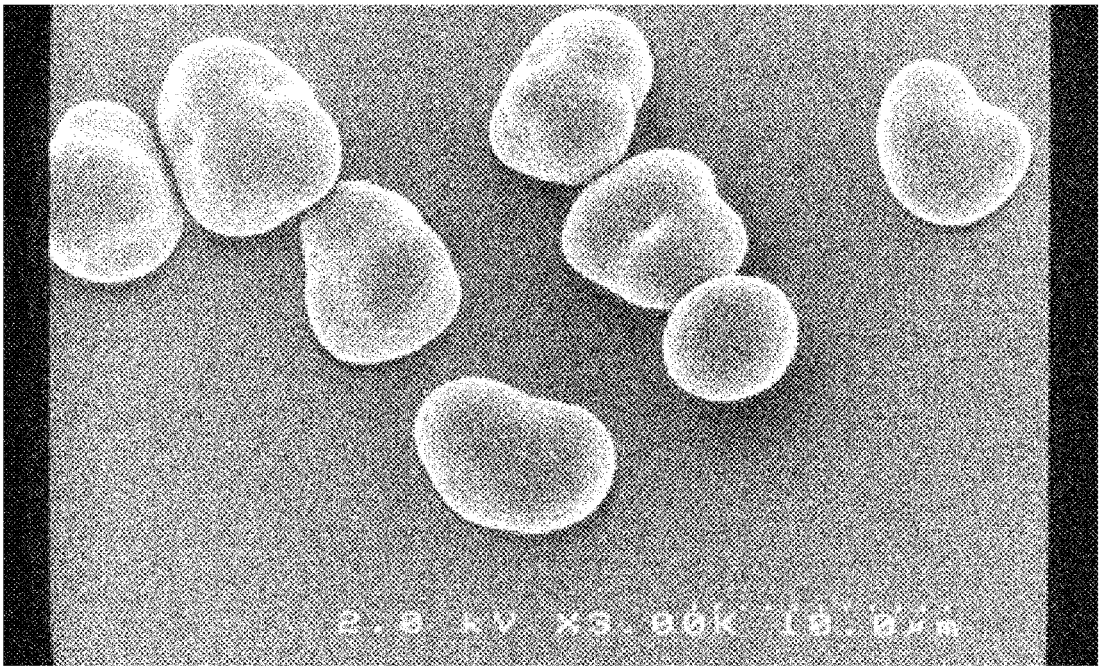
FIG. 3 is a 3000-power SEM picture of water-soluble resin-coating layer-formed particles in Example 8.
Figure 4:
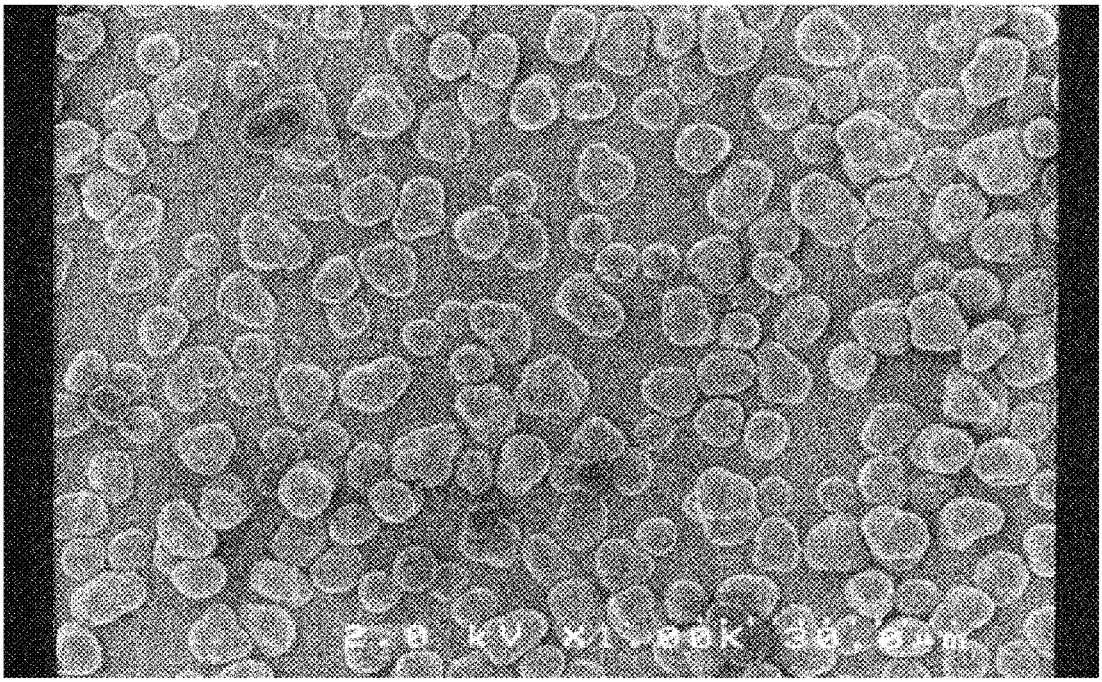
FIG. 4 is a 1000-power SEM picture of water-soluble resin-coating layer-formed particles in Example 8.
Figure 5:
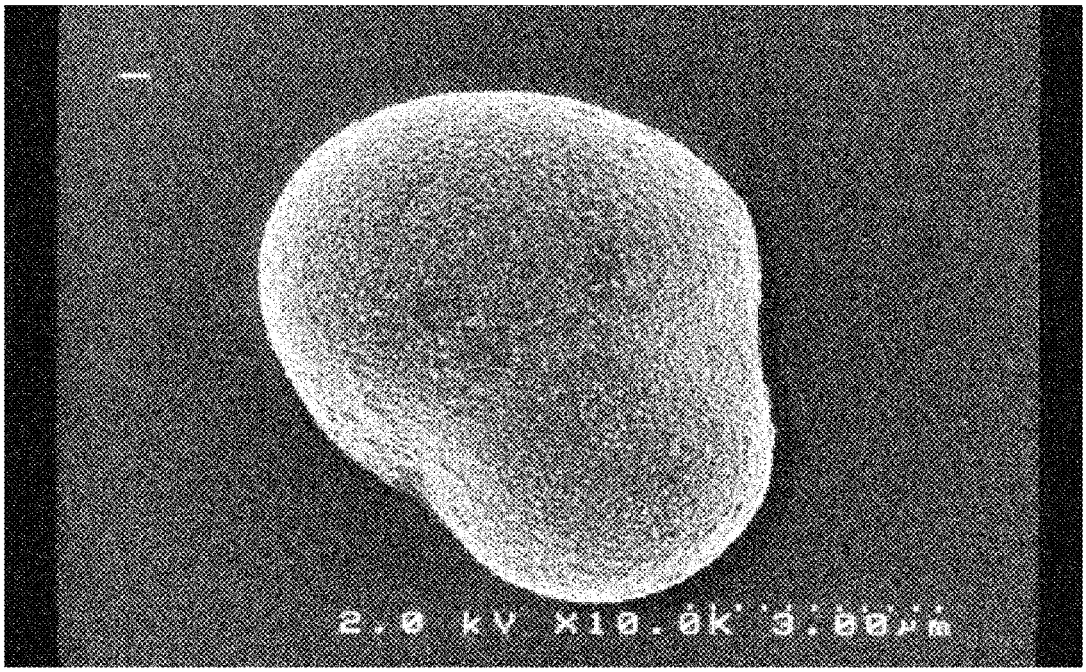
FIG. 5 is a 10000-power SEM picture of toner base particles (after shell layer formation) in Example 8.
Figure 6:
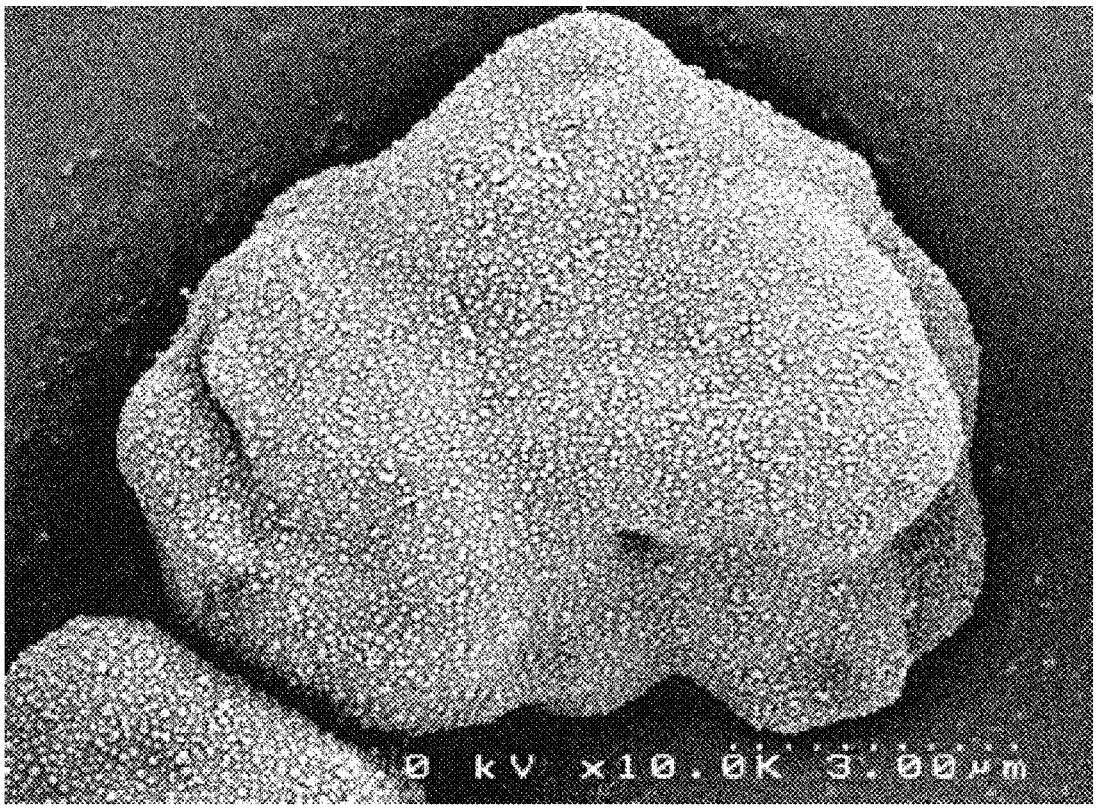
FIG. 6 is a 10000-power SEM picture of toner base particles after washed of the present invention.
Figure 7:
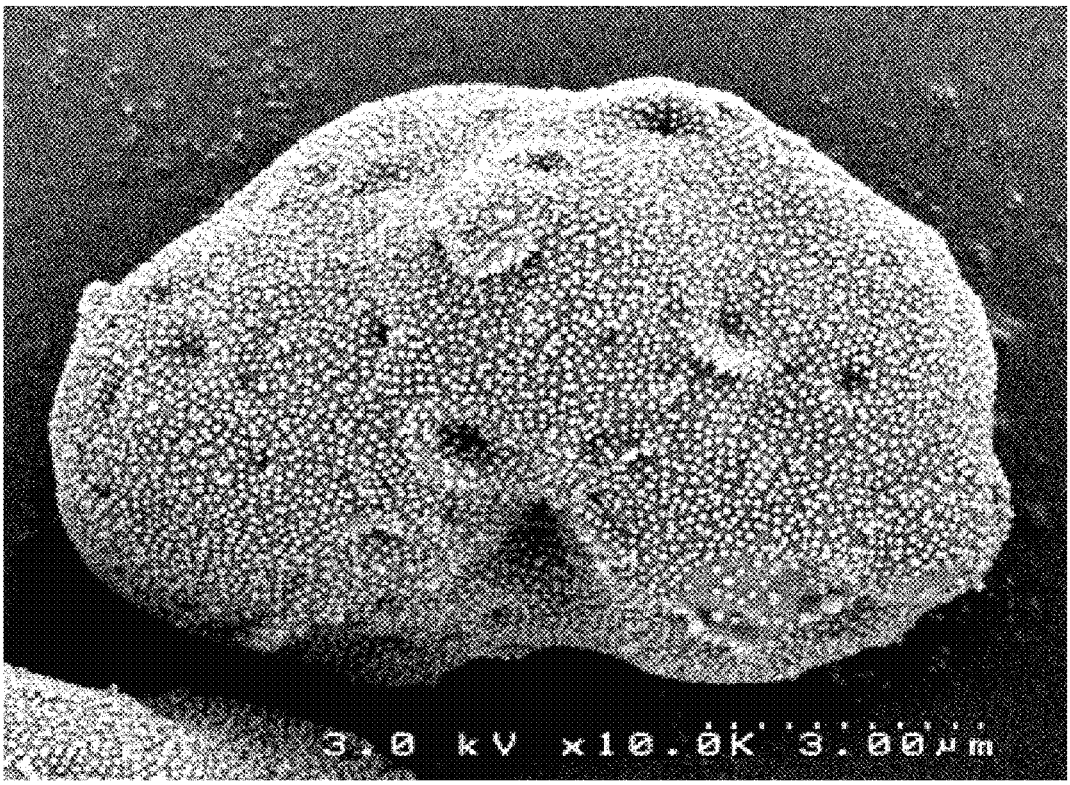
FIG. 7 is a 10000-power SEM picture of toner base particles after washed of the present invention.

The water-soluble resin coating layer is thin, which may be confirmed by comparing particles before coated with a water-soluble resin coating layer, that is, core particles in SEM pictures (FIG. 1, FIG. 2), and SEM pictures of water-soluble resin coating layer-formed particles (FIG. 3, FIG. 4), in which the particle size does not change. Before and after the formation of the water-soluble resin coating layer, the particle size of the particles does not change, from which it is presumed that the thickness of the water-soluble resin coating layer formed on the core particle would be 10 nm or less.

The water-soluble resin coating layer is a layer of a film that has a substantially smooth surface, and this may be confirmed from the comparison between those figures, in which the particle shape does not change.

(2-1. Constitution of Resin Coating Layer of Water-Soluble Resin)

As the resin to constitute the water-soluble resin coating layer, a positively-charging resin is preferred in a case where the core particles are negatively-charging ones, since the resin of the type can readily form a thin and uniform, water-soluble resin coating layer. Not specifically limited, the positively-charging resin includes resins containing an amino group such as —$NH_2$, —$NHCH_3$, —$N(CH_3)_2$, —$NHC_2H_5$, —$N(C_2H_5)_2$, —$NHC_2H_4OH$ or the like; and resins containing a quaternary ammonium salt to be formed from those groups through ammonium salt formation. Of those, resins containing a quaternary ammonium salt are preferred. In particular, in a case where the negatively-charging core particles contains a sulfonic acid group or a sulfonate group and where the positively-charging water-soluble resin contains a quaternary ammonium salt, and when the sulfonic acid group or the sulfonate group reacts with the quaternary ammonium salt to form an insoluble salt, the case is favorable since the water-soluble resin coating layer can be firmly fixed to the surface of the core particle. The quaternary ammonium salt-containing resin may be obtained from an amino group-containing polymer through treatment of the polymer into the corresponding ammonium salt thereof. The resin may also be prepared by polymerizing a monovinyl monomer containing an ammonium salt group. The polymer may be copolymerized with a monomer generally used for a binder resin. However, the method for producing the positively-charging resin is not limited to these methods.

Of the quaternary ammonium salt-containing resins, the resins having a structural unit represented by any of the following structural formula (2) to (5) are preferred.

[Chem. 2]

(2)

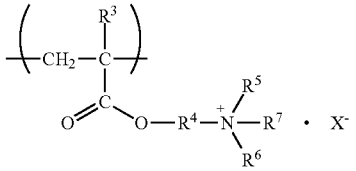

(3)

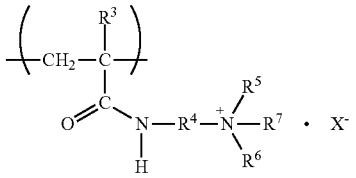

(4)

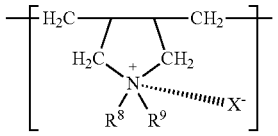

(5)

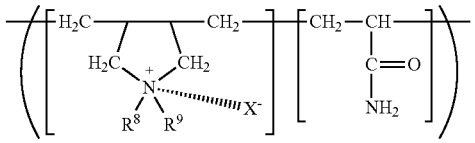

In the above-mentioned structural formulae (2) to (5), $R^3$ represents a hydrogen atom or a methyl group, $R^4$ represents an alkylene group, $R^5$ to $R^9$ each represent a hydrogen atom, or a linear, branched or cyclic alkyl group having from 1 to 6 carbon atoms, $X^-$ represents a halide ion, an alkylsulfate ion, a benzenesulfonate ion or an alkylbenzenesulfonate ion.

In the quaternary ammonium salts shown by the above-mentioned structural formulae (2) to (5), $X^-$ is preferably a chloride ion or a toluenesulfonate ion, $R^3$ is preferably a hydrogen atom or a methyl group, $R^4$ is preferably an alkylene group having from 1 to 3 carbon atoms such as $CH_2$, $C_2H_4$, $C_3H_6$ or the like, or a derivative thereof, $R^5$ to $R^9$ each are preferably an alkyl group such as $CH_3$, $C_2H_5$, $C_3H_7$ or the like.

Examples of the amino group-containing (meth)acrylate monomer include N,N-disubstituted aminoalkyl (meth)acrylate compounds such as dimethylaminomethyl (meth)acrylate, diethylaminomethyl (meth)acrylate, dipropylaminomethyl (meth)acrylate, diisopropylaminomethyl (meth) acrylate, ethylmethylaminomethyl (meth)acrylate, methylpropylaminomethyl (meth)acrylate, dimethylamino-1-ethyl (meth)acrylate, diethylamino-1-ethyl (meth)acrylate, dipropylamino-1-ethyl (meth)acrylate, diisopropylamino-1-ethyl (meth)acrylate, ethylmethylamino-1-ethyl (meth)acrylate, methylpropylamino-1-ethyl (meth)acrylate, dimethylamino-2-ethyl (meth)acrylate, diethylamino-2-ethyl (meth)acrylate, dipropylamino-2-ethyl (meth)acrylate, diisopropylamino-2-ethyl (meth)acrylate, ethylmethylamino-2-ethyl (meth)acrylate, methylpropylamino-2-ethyl (meth)acrylate, dimethylamino-2-propyl (meth)acrylate, diethylamino-1-propyl (meth)acrylate, dipropylamino-1-propyl (meth)acrylate, diisopropylamino-1-propyl (meth)

acrylate, ethylmethylamino-1-propyl (meth)acrylate, methylpropylamino-1-propyl (meth)acrylate, dimethylamino-2-propyl (meth)acrylate, diethylamino-2-propyl (meth) acrylate, dipropylamino-2-propyl (meth)acrylate, diisopropylamino-2-propyl (meth)acrylate, ethylmethylamino-2-propyl (meth)acrylate, methylpropylamino-2-propyl (meth)acrylate, etc.

Examples of the quaternating agent for use in converting an amino group into an ammonium salt include alkyl halides such as methyl iodide, ethyl iodide, methyl bromide, ethyl bromide, etc.; alkyl paratoluenesulfonates such as methyl paratoluenesulfonate, ethyl paratoluenesulfonate, propyl paratoluenesulfonate, etc.

In a case where the core particles are positively-charging ones, use of a negatively-charging resin is preferred as capable of readily forming a thin and uniform, water-soluble resin coating layer. The negatively-charging resin is not specifically limited and examples thereof include a carboxyl group-containing resin, a sulfonic acid group-containing resin, and a sulfonamide group-containing resin. The resin may be copolymerized with a monomer generally usable for binder resin. However, the production method for the negatively-charging resin is not limited to these methods.

Examples of the carboxyl group-containing monomer include acrylic acid, methacrylic acid, maleic acid, fumaric acid, succinic acid, etc. The sulfonic acid group-containing monomer includes sulfonated styrene, acrylamidesulfonic acid, etc. The sulfonamide group-containing monomer includes styrenesulfonamide, etc.

The molecular weight of the resin for use for the water-soluble resin coating layer is not specifically limited, and the weight-average molecular weight thereof in GPC is preferably from 3000 to 1,000,000. When the weight-average molecular weight is less than 3000, the adsorption force to the surface of the core particle may weaken, but when more than 1,000,000, the polymer chain is long and therefore the resin would bridging-like adsorb to plural core particles.

The content of the water-soluble resin coating layer is not specifically limited within a range not detracting from the advantageous effects of the present invention, but in general, preferably 0.01 parts by mass or more relative to 100 parts by mass of the core particles, more preferably 0.05 parts by mass or more, and in general, preferably 3 parts by mass or less. When the content is smaller than 0.01 parts by mass, the intended water-soluble resin coating layer could not be formed as a uniform layer, and when used in an amount of more than 3 parts by mass, the toner fixation performance would worsen.

(2-2. Method for Forming Resin Coating Layer of Water-Soluble Resin on Core Particles)

In forming a water-soluble resin coating layer on the surface of the core particle, it is desirable from the viewpoint of operability that a water-soluble resin as a component for forming the water-soluble resin coating layer is prepared in the form of an aqueous solution thereof and use. In addition, aqueous solutions of various types of commercial resins such as PAS-H, PAS-J (manufactured by Nittobo Medical Co., Ltd.), Jurymer AC-103 (manufactured by Toagosei Co., Ltd.) and others are usable.

The water-soluble resin coating layer may be formed by adding an aqueous solution of a water-soluble resin coating layer resin to a core particles dispersion followed by mixing them.

The temperature in mixing the core particles and the aqueous resin solution in forming the resin layer is not specifically limited, but preferably they are mixed at a temperature lower by 10° C. or more than Tg of the core particle as capable of preventing formation of aggregates of the core particles and enabling uniform mixing of the core particles and the aqueous resin solution.

After uniformly mixed, the pH, the electrolyte concentration and the temperature of the mixed liquid can be controlled. In a case where either one or both of the core particle and the water-soluble resin coating layer component have a property of changing the charging property thereof depending on pH, it is desirable to control the pH of the mixed liquid to fall within a range where the charging property of the two shows an opposite sign. In general, when the pH is controlled to fall within a range where the core particle surface and the water-soluble resin coating layer component each show an opposite charging property, the formation of the water-soluble resin coating layer may proceed, but the electrolyte concentration may be subsidiarily controlled. The electrolyte may be an inorganic or organic acid, alkali or salt.

Preferably, the temperature is controlled to be not higher than Tg+20° C. of the core particle for preventing the core particles from aggregating together.

After the formation of the water-soluble resin coating layer, the excessive water-soluble resin not adhering to the core particle surface but remaining in the aqueous medium is preferably washed away. Specifically, for the washing, the same method as that for washing the core particles may be employed.

By strictly controlling the ratio of the core particle to the water-soluble resin, it may be possible to prevent any excessive resin not adhering to the core particle surface from remaining in the aqueous medium. In this case, the washing may be omitted.

As a method for confirming the formation of the water-soluble resin coating layer, the sign of the $\xi$ potential of the dispersion is confirmed to be inverted before and after the water-soluble resin coating layer formation, or the sign of the charging amount of the powder prepared by washing and drying the dispersion is confirmed to be inverted before and after the water-soluble resin coating layer formation.

A method of preparing the water-soluble resin coating layer component as a fine particulate dispersion but not as an aqueous solution, and applying the fine particles to the core particle surface to thereby form a water-soluble resin coating layer therein may also be employable, but as compared with that in the method of using an aqueous solution, a thick layer may be formed and therefore the low-temperature fixation performance may worsen. As known from Comparative Examples to be given below, when fine particles of a hard material are used, the worsening of the low-temperature fixation performance is more remarkable.

On the other hand, in a case where the water-soluble resin coating layer component is prepared as a fine particulate dispersion, it would be difficult to thinly and uniformly coat the surface of the water-soluble resin coating layer with shell particles in the next step, and shell particles may aggregate in some areas while some other areas would not be coated with any shell particles. Though the reason is not clarified, it may be presumed that the surface of the water-soluble resin coating layer formed of fine particles is not in a uniform state due to the presence of irregularities and therefore the adhesion of shell particles to the surface would be uneven. When the amount of the shell particles to be added is increased to cover the entire surface of the water-soluble resin coating layer for the purpose of compensating the uneven coating, the shell layer may be thick and the low-temperature fixation performance would be thereby worsened.

<3. Shell Layer>

In the present invention, the morphology of the shell layer is not specifically limited, but preferably the layer is formed of particles. Hereinafter a case where the shell layer of the present invention is formed of particles is described. The particles to form the shell layer are referred to as shell particles.

The material to constitute the shell layer is not specifically limited, but preferably the shell layer contains a resin, more preferably contain a resin as the main component. Here, the main component means a component mainly playing a role of shell performance, excluding substances subsidiarily used in producing the main component such as an emulsifying agent, a dispersant and the like, and additives such as preservative and the like, and is preferably in an amount of 70% or more.

(3-1. Configuration of Shell Particles)

The shell particles to cover the surface of the water-soluble resin coating layer are not specifically limited and may be inorganic particles or resin fine particles, but from the viewpoint of particles production, particle performance control and low-temperature fixation performance, the shell particles are preferably resin fine particles.

In the case where the shell particles are resin fine particles, the resin component is not specifically defined, but is, for example, a resin generally used as a binder resin, such as styrenic resin, acrylic resin, ester resin and the like, or a copolymer or a blend thereof.

The weight-average molecular weight of the resin shell particles is preferably from 10,000 to 1,000,000, more preferably from 10,000 to 500,000, even more preferably from 10,000 to 300,000. When the weight-average molecular weight of the resin shell particles is too low the blocking resistance of the toner may worsen, and the durability thereof in a cartridge may worsen, but, on the other hand, when too high, the low-temperature fixation performance may worsen.

Tg of the resin shell particles is 55° C. or higher, preferably 60° C. or higher, and the upper limit thereof is not specifically limited when falling within a range not detracting from the advantageous effects of the present invention, and is 100° C. or lower, preferably 80° C. or lower, more preferably 75° C. or lower. In addition, Tg of the resin shell particles must be higher than Tg of the polymer primary particle in the core particle and is specifically not lower than (Tg of polymer primary particle in core particle+20°) C. The upper limit is not specifically limited but is preferably not higher than (Tg of core particle+50°) C., more preferably (Tg of core particle+40°) C. When Tg of the resin shell particles is too low, the resin shell particles may soften and the external additive may be buried in the shell particles so that the blocking resistance may worsen. On the other hand, when Tg of the resin shell particles is too high, the low-temperature fixation performance may worsen.

The content of the shell particles is not specifically limited when falling within a range not detracting from the advantageous effects of the present invention, but in general, the content is preferably 0.5 parts by mass ore more relative to 100 parts by mass of the core particles, more preferably 1.0 part by mass or more, and is preferably 8 parts by mass or less, more preferably 6 parts by mass or less. When the content is smaller than 0.5 parts by mass, the intended shell layer could be hardly formed as a uniform layer and the storage stability may worsen, but when used in an amount of more than 8 parts by mass, the toner fixation performance may worsen.

In a case where the water-soluble resin coating layer is a positively-charging one, a negatively-charging resin is preferably used for the shell particles as capable of readily forming a thin and uniform shell layer. The negatively-charging resin is not specifically limited, but is preferably a resin formed through copolymerization of a monomer having a carboxyl group, a sulfonic acid group or a sulfonamide group with a monomer generally used for a binder resin. In particular, a case where the water-soluble resin contains a quaternary ammonium salt and the negatively-charging shell particle contains a sulfonic acid group or a sulfonic acid base group is preferred because, in the case, the quaternary ammonium salt may react with the sulfonic acid group or the sulfonic acid base group to form an insoluble salt and the shell particles can be thereby firmly fixed on the surface of the water-soluble resin coating layer. Among these, a resin having a sulfonic acid group is preferred. However, the production method for the negatively-charging resin is not limited to these methods.

Preferably, a resin having a structural unit represented by the above-mentioned structural formula (4) or (5) is used to form the water-soluble resin coating layer and a resin having a structural unit represented by the following structural formula (6) is used to form the shell particles, because in the case, the charging amount can be stably maintained on a high charging level from the initial stage.

[Chem. 3]

(6)

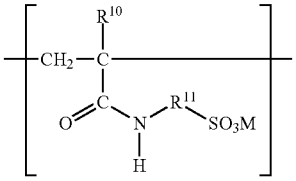

In the above-mentioned structural formula (6), $R^{10}$ represents a hydrogen atom or a methyl group, $R^{11}$ represents a linear, branched or cyclic alkylene group having from 1 to 6 carbon atoms, and M represents a hydrogen atom or an alkali metal.

In a case where the water-soluble resin coating layer is a negatively-charging one, it is desirable to use a positively-charging resin for the shell particles since a thin and uniform shell layer can be readily formed. The positively-charging resin is not specifically limited but is preferably a resin produced through copolymerization of a monomer containing an amino group such as $—NH_2$, $—NHCH_3$, $—N(CH_3)_2$, $—NHC_2H_5$, $—N(C_2H_5)_2$, $—NHC_2H_4OH$ or the like or a monomer containing a quaternary ammonium salt formed from those groups through ammonium salt formation, and a monomer generally used for a binder resin. These monomers impart positive electrification to the shell particles and also participate in emulsion stability of the shell particles, and therefore the shell particles could hardly aggregate together when forming the shell layer. Among these, a resin containing a quaternary ammonium salt is preferred. However, the production method for the positively-charging resin is not limited to these methods.

Regarding the amount of the monomer unit having a functional group that gives electrification in the binder resin in the shell particle, the lower limit is generally 0.5% by mass or more, preferably 1% by mass or more, more preferably 2% by mass or more, while on the other hand, the upper limit is generally 15% by mass or less, preferably 12% by mass or less, more preferably 10% by mass or less. When the amount of the monomer having a functional group that gives electrification is too small, the charging property of the toner after forming the shell layer would be insufficient, but too large, the charging amount of the toner under high temperature and high humidity would greatly lower to cause fogging.

The resin shell particles may be formed by dispersing or emulsifying a resin in an aqueous medium, or may be formed according to a polymerization method of emulsion polymerization, soap-free polymerization, suspension polymerization or the like, but from the viewpoint in easiness in particle size control and formation of fine particles, a polymerization is preferred.

In a case where the resin shell particles are formed through emulsion polymerization, the particles may be formed in the same manner as in the previous section of (1-2-1-1. Emulsion Polymerization) for core particles.

The volume-average particle size of the shell particles is not specifically limited falling within a range not detracting from the advantageous effects of the present invention, but is preferably 20 nm or more. Also preferably, the size is 500 nm or less, more preferably 150 nm or less.

Various commercial products can be used for the shell particles. For example, there are mentioned FCA-207P (trade name, styrene/acrylic resin) and FCA-201-PS (trade name, styrene/acrylic resin) both manufactured by Fujikura Kasei Co., Ltd., etc.

By selecting the particle size, the particle size distribution and the shape of the shell particles, the BET specific surface area of the toner base particles after formation of the shell layer can be controlled. For example, when shell particles whose volume-average particle size is 40 nm or less are selected, the BET specific surface area of the toner base particles can be reduced.

(3-2. Method for Coating Water-Soluble Resin Coating Layer with Shell Particles)

The production method for the toner having a core/shell structure includes a method of forming a core/shell structure by mixing shell particles in the latter half of the core particles formation step, and a method of coating the surfaces of the finished core particles with shell particles.

In the former case that is a heretofore-existing method, shell particles are buried in the core particles during the production process, and therefore the core particle component is exposed out of the surface of the toner base particle. When the core particles are desired to be completely coated, they must be covered with a large amount of the shell particles and, as a result, the low-temperature fixation performance would be thereby worsened.

On the other hand, in the latter case that is an embodiment to realize the present invention, the surfaces of the finished core particles are coated with a water-soluble resin coating layer and shell particles, and therefore the shell particles are not buried in the core particles during the production process and the core particles can be completely covered with a small amount of shell particles. In addition, the charging property of the water-soluble resin coating layer is opposite to that of the shell particles, and therefore, the wettability of the two resins is not high, which provides the effect of suppressing the shell particles from being buried.

In addition, since the charging property of the water-soluble resin coating layer is opposite to that of the shell particles, the shell particles could readily adhere to the surface of the water-soluble resin coating layer, but since the shell particles have the same charging property, further adhesion of additional shell articles to the shell layer previously formed could hardly occur. Consequently, a thin and uniform shell layer can be readily formed.

From the above, even though the shell layer is thin, the toner can still maintain blocking resistance and, as a result, the toner could be excellent to low-temperature fixation performance.

In the step of coating the water-soluble resin coating layer with shell particles, the shell particles may be added to and mixed with a dispersion of water-soluble resin coating layer-forming particles.

The temperature at which the water-soluble resin coating layer-formed particles are mixed with shell particles is not specifically limited, but is preferably a temperature lower by 10° C. or more than the lowest Tg among the core particles, the water-soluble resin coating layer and the shell particles, at which uniform mixing is possible with preventing the formation of aggregate particles.

After uniform mixing, the pH, the electrolyte concentration and the temperature of the mixed liquid can be controlled. For pH control, in a case where either one or both the core particle surface and the water-soluble resin coating layer component have a property capable of changing the charging property thereof depending on pH, it is desirable that the pH region is controlled to such that the two exhibit an opposite charging property therein. In general, when the water-soluble resin coating layer-formed particles and the shell particles are controlled to fall within a pH region within which the two exhibit an opposite charging property, the shell layer formation could proceed, but the electrolyte concentration may be further controlled. The electrolyte for use herein may be an inorganic or organic acid, alkali or salt.

For temperature control, preferably, the temperature is not higher than (Tg+20° C.) of the core particles for preventing aggregation of particles.

As a method for confirming the formation of the shell layer, the sign of the ξ potential of the dispersion is confirmed to be inverted before and after the shell layer formation, or the sign of the charging amount of the powder prepared by washing and drying the dispersion is confirmed to be inverted before and after the shell layer formation.

<4. Washing and Drying of Toner Base Particles>

The toner base particles coated shell particles are separated from the aqueous solvent, washed and dried, and after given optional external additives added thereto, and used for an electrostatic image developing toner.

The liquid for use for washing may be water, or the particles may also be washed with an aqueous acid or alkali solution. They may also be washed with warm water or hot water, and these methods may be combined. Through the washing step, suspension stabilizer, emulsifying agent, unreacted monomer and others can be reduced or removed. Preferably, the washing step is carried out by forming the toner base particles into a thick slurry or a wet cake, for example, through filtration, decantation or the like, followed by adding a fresh liquid for additional washing to disperse the toner base particles therein, and the operation is repeated. After washed, it is desirable that the toner base particles are collected as a wet cake from the viewpoint of the handleability thereof in the subsequent drying step.

In the drying step, there may be employed a fluidized drying method such as a shaking fluidized drying method, a circulating fluidized drying method or the like, as well as a flash drying method, a vacuum drying method, a freeze-drying method, a spray drying method, a flash jet method, etc. The operation conditions, in the drying step, including temperature, airflow, evacuation degree and others may be suitably optimized on the basis of Tg of color particles, the shape, the mechanism and the size of the device to be used, etc.

The volume-average particle size of the toner of the present invention is preferably 3 μm or more, more preferably 5 μm or more. Also preferably, the size is 15 μm or less, more preferably 10 μm or less. Regarding the shape of the toner, the mean circularity as measured with a flow particle image analyzer FPIA-3000 is preferably 0.90 or more, more preferably 0.92 or more, even more preferably 0.94 or more, and is preferably 0.99 or less. When the mean circularity is too small, the image density may lower owing to charging insufficiency to be caused by adhesion failure of external additives to the toner base particles, but when too large, the toner may cause cleaning failure owing to the shape thereof.

<ξ Potential Control>

ξ potential control is described below with reference to a negatively-charging toner taken as an example.

Preferably, the core particles and the shell particles have the same polarity, the water-soluble resin coating layer has an antipolar ξ potential relative to the core particles and the shell particles, and the ξ potential at pH 3 satisfies the relations of the following (I) to (V).

(I) ξ potential of core particles: −20 mV to −70 mV (II) ξ potential of water-soluble resin coating layer-formed particles: +40 mV to +120 mV (III) ξ potential of shell particles: −40 mV to −100 mV (IV) ξ potential of toner base particles: −30 mV to −90 mV (V) 1.0≤ξ potential of toner base particles/ξ potential of core particles≤5.0

The negatively-charging toner of the present invention uses shell particles and a positively-charging water-soluble resin each in an amount as small as possible relative to the negatively-charging core particles therein, in which the shell particles uniformly cover the core particles. Accordingly, it is desirable that the ξ potential of the core particles, the water-soluble resin coating layer-formed particles, the shell particles and the toner base particles falls within the above-mentioned range.

Preferably, the ξ potential (I) of the core particles is from −20 mV to −70 mV, more preferably from −20 mV to −50 mV.

When the ξ potential of the core particles is less than −20 mV, an antipolar water-soluble resin could hardly adhere or adsorb thereto and/or the adhesion or adsorption amount of the water-soluble resin is small and the adhesion thereof would be uneven, or the coating with shell particles in the next step would be insufficient.

On the other hand, when the ξ potential of the core particles is more than −70 mV, the water-soluble resin could readily adhere or adsorb thereto, but a large amount of the water-soluble resin must be adhered or adsorbed in order that the ξ potential of the water-soluble resin coating layer-formed particles could fall within the above-mentioned proper range. When the adhesion amount or the adsorption amount of the water-soluble resin is too large, the charging property, the environmental property and the low-temperature fixation performance of the toner would worsen.

In order that the ξ potential of the core particles can satisfy the above-mentioned requirement (I), the means is not specifically limited, but it is desirable that the content of the basic monomer is 10 wt % or less relative to all resin in the core particles. In a case where a basic amount is used in an amount more than 10 wt %, a large amount of an acid monomer must be used as the resin in the core particles for the purpose of controlling the ξ potential to fall within the above-mentioned range, and, as a result, the environmental property may worsen.

The total content of the acid monomer and the basic monomer relative to all resin in the core particles is preferably 20 wt % or less, more preferably 10 wt % or less, even more preferably 5 wt % or less.

Next, the ξ potential (II) of the water-soluble resin coating layer-formed particles is described. Since the water-soluble resin is a positively-charging one, the ξ potential (II) falls within the above-mentioned range (requirement (II)) when coating of the water-soluble resin in a suitable amount is performed. Regarding the water-soluble resin coating layer, in particular, when the resin to constitute the water-soluble resin coating layer contains a basic monomer as the constituent component, the ξ potential depends on pH and the layer could not exhibit a sufficient positively-charging property in an alkaline region, and accordingly, the ξ potential lowers. On the other hand, in an acid region, the layer could exhibit a sufficient positively-charging property, and therefore the ξ potential is high.

The ξ potential of the water-soluble resin coating layer-formed particles is preferably from +40 mV to +120 mV, more preferably from +50 to +90 mV. When the potential of the water-soluble resin coating layer-formed particles is smaller than +40 mV, adhesion of shell particles would not be sufficient and the core particles could not be coated uniformly. On the other hand, when the potential is larger than +120 mV, much shell would adhere and the fixation performance would be thereby worsened, or when the core particle is coated with a suitable amount of shell, the charging property and the environmental property of the resultant toner may worsen.

In order to control the ξ potential of the water-soluble resin coating layer-formed particles to fall within a suitable range, the means is not specifically limited, but it is desirable that the ξ potential of the core particles is controlled to fall within a suitable range according to the above-mentioned method and then the content of the basic monomer that serves as the constituent component of the resin to constitute the water-soluble resin is controlled to fall within a range of from 20 wt % to 100 wt % of all the water-soluble resin.

The ξ potential of the shell particles (requirement (III)) is preferably from −40 mV to −100 mV, more preferably from −40 mV to −80 mV.

The ξ potential of the shell particles is preferably high from the viewpoint that, when shell particles are added, the shell particles do not aggregate together but could adhere selectively to the surfaces of the water-soluble resin coating layer-formed particles. However, when the ξ potential of the shell particles is too high, it is undesirable since the coating amount with the shell particles would be insufficient or the coating with the shell particles would be uneven.

In order to sufficiently secure the coating amount with the shell particles, there may be employed a method of increasing the coating amount with the water-soluble resin so that the ξ potential of the water-soluble resin coating layer-formed particles could be higher than the above-mentioned range. However, excessive use of the water-soluble resin may worsen the charging property and the environmental property, as mentioned above. In addition, in order to increase the ξ potential of the water-soluble resin coating layer-formed particles, a large amount of a basic monomer must be used, which, similarly, may also worsen the environmental property.

In order that the coating with the shell particles could be uniform and the amount could be a suitable one, it is desirable that the ξ potential of the shell particles and the ξ potential of the water-soluble resin coating layer-formed particles are controlled to fall within the above-mentioned range. The means for controlling the ξ potential of the shell particles is not specifically limited, but the ξ potential thereof may be controlled by controlling the content of the acid monomer in the resin to constitute the shell particles, and the content is preferably from 0.5 wt % to 20 wt % of the entire resin.

When the content of the acid monomer is less than 0.5 wt %, the ξ potential of the shell particles is low, and therefore when the shell particles are added, the shell particles may aggregate together simultaneously with adhering to the water-soluble resin coating layer-formed particles. On the other hand, when the content of the acid monomer is larger than 20 wt %, the ξ potential would be too high so that the shell adhesion amount may be insufficient and the environmental property may be thereby worsened.

The acid monomer is not specifically limited, but is preferably one containing a sulfonic acid group or a sulfonic acid base group.

After the core particles are coated with a water-soluble resin, it is desirable that the pH of the dispersion of the water-soluble resin coating layer-formed particles is once controlled to fall within an alkaline region. With that, it is important that the ξ potential of the water-soluble resin coating layer-formed particles can exhibit negative polarity. Since the water-soluble resin itself does not exhibit a sufficient positively-charging property under an alkaline condition and since the core particles exhibit a high negatively-charging property under an alkaline condition, the coated particles exhibit negative polarity in an alkaline region.

This phenomenon could be explained in point of pKa and pKb in the case where an acid monomer is used as the core particles and a basic monomer is as the water-soluble resin. The water-soluble resin coating layer-formed particles are so planned that the particles could exhibit a strong negatively-charging property under an alkaline condition, that is, the particles could have a highly negative-polar potential under the condition, and shell particles are added to the water-soluble resin coating layer-formed particles under an alkaline condition, and thereafter the pH is controlled to be in an acidic region. This production method is more preferred.

When shell particles are added to the water-soluble resin coating layer-formed particles under an acidic condition, the adhesion of the shell particles to the water-soluble resin layer coating layer-formed particles is more rapid than the diffusion of the shell particles, and there may occur a state where toner base particles (negatively-charging), toner base particles partially coated with shell particles adhering thereto (positively-charging) and water-soluble resin coating layer-formed particles (positively-charging) exist together as mixed. Accordingly, the negatively-charging toner base particles, and the partially shell-adhered positively-charging toner base particles as well as the positively-charging, water-soluble resin coating layer-formed particles would aggregate to degrade the particle size distribution.

On the other hand, when shell particles are added under an alkaline condition and then, after the shell particles have been fully diffused to be uniform, the system is made to be acidic, the process can evade the problem. The pH control during production may be attained by addition of acid or base, and an acid is, after addition, able to diffuse to be uniform far rapidly than shell particles, and is therefore considered to be free from the above-mentioned problem.

Owing to insufficient adhesion or adsorption of water-soluble resin to core particles, there may be a possibility that the water-soluble resin coating layer-formed particles could not exhibit sufficient negative polarity in an alkaline region. In this case, there may occur aggregation like in the case where shell particles are added, and the case is unfavorable.

Consequently, the ξ potential of the water-soluble resin coating layer-formed particles is preferably from −20 mV to −100 mV at pH 11.

When the ξ potential of the water-soluble resin coating layer-formed particles is lower than −20 mV at pH 11, there may occur aggregation when shell particles are added under an alkaline condition. On the other hand, when the planning and the adhesion amount control of the core particles and the water-soluble resin are suitably attained, the potential is not over −100 mV.

The ξ potential of the toner base particles is preferably from −30 mV to −90 mV, and also preferably, 1.0≤ξ potential of toner base particles/E, potential of core particles ≤5.0.

When the ξ potential of the core particles, the ξ potential of the water-soluble resin coating layer-formed particles and the ξ potential of the shell particles are suitably controlled according to the above-mentioned method and when a uniform coating is formed, the ξ potential of the toner base particles is to fall within the above-mentioned range. When the ξ potential of the toner base particles is lower than −30 mV and/or when the ratio of the ξ potential of toner base particles/the ξ potential of the core particles is smaller than 1.0, there might have occurred some failures in that the adhesion amount of the shell particles is not sufficient, or uneven. When the ξ potential is larger than −90 mV and/or when the ratio of the ξ potential of the toner base particles/the ξ potential of the core particles is larger than 5.0, there might have occurred some failures in that the adhesion amount of the shell particles is excessive or the shell particles have aggregated together.

<5. External Additive>

(5-1. External Additive)

In the present invention, if desired, an external additive may be added for improvement of toner flowability or for improvement of electrification control. As the external additive, any one may be suitably selected from various inorganic or organic fine particles, and may be used. Two or more types of external additives may be used as combined.

As the inorganic fine particles, usable are various carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, etc.; various nitrides such as boron nitride, titanium nitride, zirconium nitride, etc.; various borides such as zirconium boride, etc.; various oxides such as titanium oxide, calcium oxide, magnesium oxide, zinc oxide, copper oxide, aluminium oxide, cerium oxide, silica, colloidal silica, etc.; various titanate compounds such as calcium titanate, magnesium titanate, strontium titanate, etc.; various phosphoric acid compounds such as calcium phosphate, etc.; sulfides such as molybdenum disulfide, etc.; fluorides such as magnesium fluoride, carbon fluoride, etc.; various metal soaps such as aluminium stearate, calcium stearate, zinc stearate, magnesium stearate, etc.; talc, bentonite, various carbon blacks, electroconductive carbon black, magnetite, ferrite, etc. As the organic fine particles, usable are fine particles of styrenic resin, acrylic resin, epoxy resin, melamine resin, etc. Fluorine atom-containing fine particles may also be used for improving charging stability.

Of those external additives, in particular, silica, titanium oxide, alumina, zinc oxide, various carbon blacks, electroconductive carbon black and the like are preferably used.

Regarding the external additives, the surfaces of the inorganic or organic fine particles may be surface-treated for hydrophobization with a treating agent including a silane coupling agent such as hexamethyldisilazane (HMDS), dimethyldichlorosilane (DMDS), etc., a titanate coupling agent, a silicone oil treating agent such as silicone oil, dimethylsilicone oil, modified silicone oil, amino-modified silicone oil, etc., a silicone varnish, a fluorine-containing silane coupling agent, a fluorine-containing silicone oil, a coupling agent having an amino group or a quaternary ammonium base or the like, and the thus surface-treated ones are usable here. Two or more such treating agents may be used as combined.

The amount of the external additive to be added is preferably 0.5 parts by mass or more relative to 100 parts by mass of the toner base particles, more preferably 0.8 parts by mass or more, and is preferably 5 parts by mass or less, more preferably 4 parts by mass or less.

In general, when blocking resistance is desired to be improved by increasing the content of external additive, low-temperature fixation performance may worsen, but in the toner of the present invention, the blocking resistance can be readily improved by increasing the content of the external additive, while, on the other hand, the low-temperature fixation performance hardly worsens.

Though not clear, the reason may be presumed as follows. A major part of the external additive is positioned on the shell particles, and therefore, when the amount of the external additive is increased, the amount of the external additive existing in the outermost surface of the toner increases and accordingly the blocking resistance can be effectively improved. In addition, since the shell is formed of particles, there exist void spaces between the shell particles, and it is considered that, during fixation, the core components may move outward through the spaces to express low-temperature fixation performance. Accordingly, even though the amount of the external additive is increased, the void spaces would not be completely sealed up but would partly remain as such and, as a result, the low-temperature fixation performance could be maintained.

In the toner of the present invention, from the viewpoint of electrification control, electroconductive fine particles may be used as the external additive. Regarding the resistance of electroconductive fine particles, the upper limit thereof is generally 400 Ω·cm or less, preferably 200 Ω·cm or less, more preferably 100 Ω·cm or less, even more preferably 60 Ω·cm or less. On the other hand, the lower limit is generally 0.1 Ω·cm or more, preferably 1 Ω·cm or more, more preferably 5 Ω·cm or more, even more preferably 15 Ω·cm. Examples of the electroconductive fine particles include metal oxides such as electroconductive titanium oxide, silica, magnetite, etc., or those metal oxides doped with an electroconductive substance, organic fine particles prepared by doping a conjugated double bond-having polymer, such as polyacetylene, polyphenylacetylene, poly-p-phenylene or the like, with an electroconductive substance such as metal or the like, and carbon typified by carbon black, graphite, etc. From the viewpoint of the ability to impart electroconductivity not detracting from the flowability of the toner, electroconductive titanium oxide, or those doped with the electroconductive substance are more preferred. Regarding the content of the electroconductive fine particles, the lower limit is generally 0.05 parts by mass or more relative to 100 parts by mass of the toner base particles, preferably 0.1 parts by mass or more, more preferably 0.2 parts by mass or more. On the other hand, the upper limit of the content of the electroconductive fine particles is generally 3 parts by mass or less, preferably 2 parts by mass or less, more preferably 1 part by mass or less.

(5-2. External Addition Method for External Additive)

The addition method for the external additive includes a method using a high-speed stirrer such as a Henschel mixer or the like, a method using a device capable of imparting compression shear stress, etc.

The external additive-containing toner may be produced according to a one-stage external addition method where external additives are added to toner base particles all at a time, but may be produced according to a stepwise external addition method where external additives are added externally individually.

For preventing temperature elevation during external addition, it is desirable to provide a cooling device for the container or to employ stepwise external addition.

(6. Others)

The electrostatic image developing toner of the present invention may be in any form for a two-pack developing agent where toner is used along with carrier, or a magnetic or nonmagnetic one-pack developing agent not using carrier. In a case where the toner is used for a two-pack developing agent, the carrier to be used may be any known one including magnetic substances such as iron powder, magnetite powder, ferrite powder, etc., or those coated with resin on the surfaces thereof, magnetic carriers, etc. The coating resin for the resin-coated carrier may be any known one including styrenic resin, acrylic resin, styrene-acrylic copolymer resin, silicone resin, modified silicone resin, fluororesin, or mixtures thereof, etc.

EXAMPLES

The invention is described more concretely with reference to the following Examples; however, not overstepping the spirit and the scope thereof, the invention is not limited to the following Examples. In the following Examples, "part" is "part by weight".

Each particle diameter and circularity, and the electric conductivity, thermal properties and others were measured as follows.

<Measurement of Median Diameter (D50)>

The median diameter (D50) of particles having a median diameter (D50) smaller than 1 micron was measured using Nikkiso's Model, Microtrac Nanotrac 150 (hereinafter abbreviated as "Nanotrac") and the same company's analysis software Microtrac Particle Analyzer Ver 10. 1.2-019EE. A sample was analyzed according to the method described in the instruction manual and using ion-exchanged water having an electric conductivity of 0.5 μS/cm as a solvent, under the measurement conditions of solvent refractive index: 1.333, measurement time: 120 seconds, measurement frequency: five times, and the found data were averaged to give a mean value. Regarding the other setup conditions, the particle refractive index was 1.59, the permeability was yes (permeable), the shape was true spherical and the density was 1.05.

<Measurement of Volume Median Diameter (Dv50)>

The volume median diameter (Dv50) of particles having a volume median diameter (Dv50) of 1 micron or more was measured using Beckman Coulter's Multisizer III (aperture diameter 100 μm) (hereinafter abbreviated as "Multisizer"). As the dispersion medium, the same company's Isoton II was used, and the particles were dispersed to have a dispersoid concentration of 0.03%, and analyzed.

<Measurement of Mean Circularity>

The mean circularity was measured using a flow particle analyzer (Sysmex's FPIA3000), in which a dispersoid was dispersed in a dispersion medium (Cellsheath, manufactured by Sysmex) to contain from 5720 to 7140 particles/μl, and analyzed in an HPF mode under the conditions of HPF analysis amount 0.35 μm, and HPF detection amount 2000 to 2500 particles.

<Measurement of Electroconductivity>

Electroconductivity was measured using a conductivity meter (AS ONE's Cyber Scan CON 100).

<Weight-Average Molecular Weight (Mw)>

The THF soluble component in dried products of polymer primary particle dispersion and shell particle dispersion was measured through gel permeation chromatography (GPC) under the following condition.

Apparatus: Tosoh's GPC device, HLC-8020
Column: Polymer Laboratory's PL-gel Mixed-B 10μ
Solvent: THF
Sample concentration: 0.1 wt %
Calibration curve: standard polystyrene An aqueous solution of water-soluble resin coating layer D1 was analyzed through gel permeation chromatography (GPC) under the following condition.

Apparatus: Tosoh's GPC device, HLC-8010
Column: Tosoh's TSKgel, GMPW×1
Solvent: aqueous solution of 0.5 M acetic acid+0.5 M sodium acetate
Sample concentration: 0.2 wt %
Calibration curve: polyethylene glycol <Measurement of glass transition temperature (Tg)>

Using a differential thermal analyzer (DSC 200) manufactured by Seiko Instruments Inc., a dried sample was analyzed under the condition of a heating rate 10° C./min. Tg was obtained from the intersection of the extended line from the base line of the DSC curve and the tangent line showing the maximum inclination of the endothermic curve.

<Measurement of Charging Amount>

Powder Tec's F-80 was used as a carrier. 10 g of a mixture with the carrier in a ratio by weight of 1/24 was put into a glass sample bottle having a volume of 30 ml, and shaken for 1 minute, using a mixer mill manufactured by Mitamura Riken Co., Ltd., at a vibration frequency of 600 rpm. 0.1 g of the resultant mixture was analyzed using a blow-off charging amount measuring device manufactured by Toshiba Chemical Corporation, according to a suction blow-off method.

Blow condition: 0.05 kgf×3 sec
Suction pressure: 350 to 400 $mmH_2O$
Screen: 400 mesh <Measurement of ξ Potential>

Using Zeta Sizer Nano (manufactured by Malvern Instruments Ltd.), ξ potential was measured. A core particle dispersion, a water-soluble resin coating layer forming particle dispersion and a shell particle dispersion each was diluted with pure water to 1/1000, and analyzed.

<Weight Reduction at 200° C. of Wax>

Weight reduction at 200° C. of wax was measured, using Hitachi High-Tech Science Corporation's TG/DTA6200 and EXSTAR 6000. Based on the maximum weight, the period of time for which the weight reduction reached 0.1% was measured.

Sample container: platinum sample pan
Reference: sample pan alone
Sample amount: 30 to 31 mg
Atmosphere: nitrogen (flow rate 200 ml/min)
Temperature condition
Start temperature: 28° C.
Heating rate: 10° C./min
Holding temperature: 200° C.

Example 1

<Preparation of Black Colorant Dispersion>

In a container with a stirrer equipped with a propeller, 20 parts of carbon black, which had been produced according to a furnace process, which has a true viscosity of 1.8 g/cm$^3$ and whose toluene extract had UV absorbance of 0.02 (manufactured by Mitsubishi Chemical Corporation, Mitsubishi Carbon Black MA 100S), 1 part of an aqueous solution of 20% sodium dodecylbenzenesulfonate (hereinafter abbreviated as 20% DBS aqueous solution), 4 parts of a nonionic surfactant (manufactured by Kao Corporate, Emulgen 120) and 75 parts of ion-exchanged water having an electroconductivity of 2 μS/cm were put, and pre-dispersed therein to prepare a pigment premix liquid. After premixed, the volume cumulative 50% diameter Dv50 of the carbon black in the dispersion was about 90 μm. The above premix liquid was used as a source material slurry and fed into a wet-process bead mill and dispersed in one-pass operation. The inner diameter of the stator was 120 mmφ, the diameter of the separator was 60 mmφ, and as a medium for dispersion, zirconia beads having a diameter of 50 μm (true density: 6.0 g/cm$^3$) were used. The effective internal volume of the stator was 2 liters, and the media-filling volume was 1.4 liters, and therefore the media-filling rate was 70%. The revolution speed of the rotor was kept constant (the peripheral speed of the rotor tip was about 11 m/sec), and the previous premix slurry was fed through a non-pulsatile metering pump at a feeding rate of about 40 liter/hr from a supply port, and when the particle size reached the predetermined level, the product was collected through the discharge spout. During the operation, cooling water at about 10° C. was circulated through the jacket, and a black colorant dispersion was thus obtained.

<Preparation of Wax Dispersion A1>

27.2 parts of paraffin wax (melting point 75° C., 0.1% weight loss time 14 minutes), 2.8 parts of stearyl acrylate, 1.9 parts of 20% DBS aqueous solution, and 68.1 parts of desalted water were heated at 90° C., and stirred for 10 minutes using a homomixer (manufactured by PRIMIX Corporation, Mark IIf Model). Next, under heat at 90° C. and using a high-pressure emulsifying machine, this was subjected to circulating emulsification under a pressure condition of 20 MPa and dispersed until the median diameter (D50) as measured with Nanotrac could reach 250 nm or less, thereby preparing a was dispersion A1. The final particle size (D50) was 244 nm.

<Preparation of Polymer Primary Particle Dispersion B1>

36.3 parts of the wax dispersion A1 and 260 parts of desalted water were put in a reactor equipped with a stirring device (three propellers), a heating and cooling device, a concentrating device, and source material/auxiliary agent feeding devices, and heated up to 90° C. with stirring in a nitrogen stream atmosphere.

Subsequently, still with stirring, a mixture of the following monomers and aqueous emulsifying agent solution was added taking 300 minutes. The time at which addition of the monomers/aqueous emulsifying agent solution mixture was started was referred to as polymerization start, and in 30 minutes after the polymerization start, the following aqueous initiator solution 1 was added taking 270 minutes. Subsequently, the following aqueous initiator solution 2 was added taking 120 minutes. Subsequently, this was kept with stirring at an internal temperature of 90° C. for 60 minutes.

[Monomers]

| | |
|---|---|
| Styrene | 67.8 parts |
| Butyl acrylate | 32.2 parts |
| Acrylic acid | 1.5 parts |
| Trichlorobromomethane | 1.0 part |
| Hexanediol diacrylate | 1.2 parts |

[Aqueous Emulsifying Agent Solution]

| | |
|---|---|
| Aqueous 20% DBS solution | 1.0 part |
| Desalted water | 67.5 parts |

[Aqueous Initiator Solution 1]

| | |
|---|---|
| 8% hydrogen peroxide aqueous solution | 15.5 parts |
| 8% L-(+)ascorbic acid aqueous solution | 15.5 parts |

[Aqueous Initiator Solution 2]

| | |
|---|---|
| 8% L-(+)ascorbic acid aqueous solution | 14.2 parts |

After the polymerization reaction, the system was cooled to give a milky white polymer primary particle dispersion B1. The median diameter (D50), as measured with Nanotrac, was 265 nm. The weight-average molecular weight (Mw) was 44000. Tg was 36° C.

<Preparation of Core Particle Dispersion C1>

100 parts (solid content) of the polymer primary particle dispersion B1 was put in a mixer equipped with a stirring device, a heating and cooling device, and source material/auxiliary agent feeding devices, and further, 7.5 parts (solid content) of the black colorant dispersion was added thereto taking 5 minutes, and mixed uniformly, and then 0.31 parts (solid content) of an aqueous solution of 0.5% aluminium sulfate was added taking 15 minutes. Further, this was heated up to an internal temperature of 45° C. taking 150 minutes. With that, using a multisizer, the volume medium particle size (Dv50) was measured and was 6.1 μm. Subsequently, 4.1 parts (solid content) of 20% DBS aqueous solution was added, then heated up to 96° C. taking 50 minutes, held as such for 50 minutes, and the cooled to 30° C. The ξ potential at pH 1.9 was −30.2 mV.

The resultant dispersion was taken out and filtered under reduced pressure through an aspirator using filter paper of Grade 5C (manufactured by Toyo Roshi Kaisha, Ltd., No. 5C). The cake having remained on the filter paper was transferred into a stainless container equipped with a stirrer (with propellers), and ion-exchanged water having an electroconductivity of 1 μS/cm was added and uniformly dispersed with stirring, and thereafter further stirred for 30 minutes. This step was repeated until the electroconductivity of the filtrate could reach 10 μS/cm, and then ion-exchanged water having an electroconductivity of 1 μS/cm was added to the cake having remained on the filter paper to such a degree that the dispersion concentration could be 20%, and stirred to give a core particle dispersion C1.

Reference Example

A core particle dispersion was prepared in the same manner as that for C1except that the amount of acrylic acid was changed to 1.2 parts. Washing was repeated until the electroconductivity of the filtrate could reach 2μS/cm, and then the resultant cake was dried in an air drier set at 40° C. for 48 hours, and the charging amount thereof was measured and was −1 μC/g.

<Preparation of Water-Soluble Resin Coating Layer Aqueous Solution D1>

480 parts of desalted water was put in a reactor equipped with a stirring device (three propellers), a heating and cooling device, a concentrating device, and source material/auxiliary agent feeding devices, and heated up to 70° C. with stirring in a nitrogen stream atmosphere.

Subsequently, the initiator aqueous solution 1 was added and after 5 minutes, the following monomers and the initiator aqueous solution 2 were added still with stirring, taking 60 minutes. Subsequently, the initiator aqueous solution 3 was added taking 60 minutes, and simultaneously with the start of addition, this was heated up to 90° C. After the initiator aqueous solution 3 was added, this was held at the internal temperature of 90° C. with stirring for 90 minutes.

[Monomers]

| | |
|---|---|
| Blemmer QA (manufactured by NOF Corporation, (2-hydroxy-3-methacryloxypropyl) trimethylammonium chloride, 50% aqueous solution) | 10.0 parts |

[Initiator Aqueous Solution 1]

| | |
|---|---|
| 8.0% 2,2'-azobis(2-methylpropionamidine) dihydrochloride aqueous solution | 3.0 parts |

[Initiator Aqueous Solution 2]

| | |
|---|---|
| 8.0% 2,2'-azobis(2-methylpropionamidine) dihydrochloride aqueous solution | 3.0 parts |

[Initiator Aqueous Solution 3]

| | |
|---|---|
| 8.0% 2,2'-azobis(2-methylpropionamidine) dihydrochloride aqueous solution | 3.0 parts |

Cooling after the polymerization reaction gave a water-soluble resin coating layer aqueous solution D1. The weight-average molecular weight (Mw) was 7600.

<Preparation of Shell Particle Dispersion E1>

2.0 parts of 20% DBS aqueous solution and 323 parts of desalted water were put in a reactor equipped with a stirring device (three propellers), a heating and cooling device, a concentrating device, and source material/auxiliary agent feeding devices, and heated up to 80° C. with stirring in a nitrogen stream atmosphere.

Subsequently, the initiator aqueous solution was added still with stirring, and after 5 minutes, a mixed emulsion of the following monomers 1 and emulsifying agent solution, and the monomers 2 were added, taking 210 minutes. Subsequently, this was held at the internal temperature of 80° C. with stirring for 90 minutes.

[Monomers 1]

| | |
|---|---|
| Styrene | 83.5 parts |
| Butyl acrylate | 16.5 parts |

[Emulsifying Agent Aqueous Solution]

| | |
|---|---|
| 20% DBS aqueous solution | 1.0 part |
| Desalted water | 71.4 parts |

[Monomers 2]

| | |
|---|---|
| 20% sodium parastyrenesulfonate aqueous solution | 12.5 parts |

[Initiator Aqueous Solution]

| | |
|---|---|
| 4.0% potassium persulfate aqueous solution | 6.4 parts |

Cooling after the polymerization reaction gave a milky white, shell particle dispersion E1. The median diameter (D50), as measured with Nanotrac, was 63 nm. The weight-average molecular weight (Mw) was 242,000. Tg was 72° C. The ξ potential at pH 2.8 was −55.2 mV.

<Production of Toner Base Particles F1>

100 parts (solid content) of the core particle dispersion C1 was put in a reactor equipped with a stirring device and a heating and cooling device, and with stirring at room temperature, 0.15 parts (solid content) of the water-soluble resin coating layer aqueous solution D1 was added and stirred at room temperature for 30 minutes. Subsequently, 1 N—NaOH aqueous solution was added in an amount of 7.5 g/1 L dispersion volume, and then the dispersion was heated up to an internal temperature of 50° C., kept as such for 60 minutes, and then cooled to 30° C. The ξ potential at pH 2.9 was +53.5 mV.

The resultant dispersion was taken out and filtered under reduced pressure through an aspirator using filter paper o f Grade No. 5C. Ion-exchanged water having an electroconductivity of 1μS/cm was sprayed over the cake having remained on the filter paper until the electroconductivity of the filtrate could reach 10μS/cm. Ion-exchanged water having an electroconductivity of 1μS/cm was added to the cake remaining on the filter paper in such a manner that the dispersion concentration could be 20%, to disperse the cake by stirring.

A part of the dispersion was repeatedly washed until the e electroconductivity of the filtrate could reach 2μS/cm, and the resultant cake was dried in an air drier set at 40° C. for 48 hours. The charging amount of the cake was measured and was +6μC/g.

100 parts (solid content) of the above dispersion was put in a reactor equipped with a stirring device and a heating and cooling device, and with stirring at an internal temperature of 20° C., 3 parts (solid content) of the shell particle dispersion E1 was dropwise added and stirred at room temperature. Subsequently, 1 N—HCl aqueous solution was added dropwise in an amount of 10 g/1 L dispersion volume, and then the dispersion was heated up to an internal temperature of 50° C., kept as such for 120 minutes, and then cooled to 30° C. The volume median diameter (Dv50) measured with Multisizer III was 8.3 μm, and the mean circularity measured with a flow particle analyzer was 0.947. The ξ potential at pH 3.0 was −68.1 mV.

The resultant dispersion was taken out and filtered under reduced pressure through an aspirator using filter paper of Grade No. 5C. The cake having remained on the filter paper was transferred into a stainless container equipped with a stirrer (with propellers), and ion-exchanged water having an electroconductivity of 1μS/cm was added and uniformly dispersed with stirring at 50 rpm, and thereafter further stirred for 30 minutes.

This step was repeated until the electroconductivity of the filtrate could reach 2 μS/cm, and then the resultant cake was dried in an air drier set at 40° C. for 48 hours to give toner base particles F1. The charging amount was measured and was −2 μC/g.

<Production of Toner G1 for Development>

100 parts of the toner base particles F1 were put in a sample mill KR-3 manufactured by Kyoritsu Riko Co., Ltd., and subsequently 0.5 parts of silica fine particles having a volume-average primary particle size of 0.03 μm were added thereto and mixed by stirring for a total of 2 minutes. Subsequently, 1.0 part of silica fine particles having a volume-average primary particle size of 0.01 μM were added and mixed by stirring for a total of 2 minutes, and sieved to give a toner G1 for development.

Example 2

<Preparation of Polymer Primary Particle Dispersion B2>

A polymer primary particle dispersion B2 was produced according to the same method as that for B1, except that the monomers were changed as follows. The weight-average molecular weight (Mw) was 48000. Tg was 33° C.

[Monomers]

| | |
|---|---|
| Styrene | 65.5 parts |
| Butyl acrylate | 34.5 parts |
| Acrylic acid | 1.5 parts |
| Trichlorobromomethane | 1.0 part |
| Hexanediol diacrylate | 1.2 parts |

<Preparation of Core Particle Dispersion C2>

A core particle dispersion C2 was produced according to the same method as that for C1 except that the polymer primary particle dispersion B2 was used in place of B1.

<Production of Toner Base Particles F2>

Toner base particles F2 were produced according to the same method as that for F1 except that 0.07 parts (solid content) of PAS-H-10L (manufactured by Nittobo Medical Co., Ltd., diallyldimethylammonium chloride polymer 28% aqueous solution, weight-average molecular weight (Mw) 200,000) was used in place of the water-soluble resin coating layer aqueous solution D1. The volume median diameter (Dv50) measured with Multisizer III before washing was 7.7 μm, and the mean circularity measured with a flow particle analyzer was 0.951.

<Production of Toner G2 for Development>

A toner G2 for development was produced in the same manner as that for G1 except that the toner base particles F2 were used in place of F1.

Comparative Example 1

<Production of Toner Base Particles F3>

Toner base particles F3 were produced according to the same method as that for F1 except that 0.15 parts (solid content) of Blemmer QA was used in place of the water-soluble resin coating layer aqueous solution D1. The volume median diameter (Dv50) measured with Multisizer III before washing was 12.0 μm.

<Production of Toner G3 for Development>

A toner G3 for development was produced in the same manner as that for G1 except that the toner base particles F3 were used in place of F1.

Comparative Example 2

<Production of Toner Base Particles F4>

Toner base particles F4 were produced according to the same method as that for F2 except that 3.0 parts (solid content) of AERODISP W440 (manufactured by Nippon Aerosil Co., Ltd., alumina 40% aqueous dispersion) was used in place of the water-soluble resin coating layer aqueous solution D1. The volume median diameter (Dv50), measured with Multisizer III, of F4 before washing was 6.9 μm, and the mean circularity measured with a flow particle analyzer was 0.951.

<Production of Toner G4 for Development>

A toner G4 for development was produced in the same manner as that for G1 except that the toner base particles F4 were used in place of F1.

The toners for development obtained in Examples 1 and 2 and Comparative Examples 1 and 2 were evaluated according to the following methods.

<Blocking Resistance>

5 g of the toner for development was put in a cylindrical container having an inner diameter of 3 cm and a height of 6 cm, a load of 40 g was applied thereto, and left in an environment at a temperature of 50° C. and a humidity of 40% for 24 hours, and then the toner was taken out of the container, and a load was applied thereto from the above to confirm the degree of aggregation of the toner.

A: Crushed under a load of less than 200 g.

B: Crushed under a load of less than 500 g.

C: Aggregated, and crushed only when given a load of 500 g or more.

<Fixation Test>

A fixing machine with a heating roller fixation system was used. In the heating roller of the fixing machine, the upper roller has a heater, and the lubricant layer thereof is formed of PFA (tetrafluoroethylene-perfluoroalkyl vinyl ether copolymer), and given no application of silicone oil during the evaluation. A recording sheet (FC Dream manufactured by Kishu Paper Co., Ltd.) carrying an unfixed toner image with an adhesion amount of about 0.7 mg/cm$^2$ was prepared, the surface temperature of the heating roller was varied from 100° C. to 210° C. at intervals of 5° C., the sheet was conveyed to the fixation nip part, and the fixation state of the sheet discharged out at a speed of 195 mm/sec was observed. The temperature range within which offset of the toner or winding of the recording sheet on the heating roller at fixation is not caused the toner on the recording sheet after fixation sufficiently adhered to the recording sheet is referred to as a fixation temperature range ΔT, and the toner was evaluated as follows.

A: ΔT≥50° C.

B: 50° C.>ΔT≥30° C.

C: ΔT<30° C.

TABLE 1

| | Example 1 | Example 2 | Comparative Example 1 | Comparative Example 2 |
|---|---|---|---|---|
| Blocking Resistance | A | A | C | A |
| Fixation Performance | A | A | — | C |

As shown in Table 1, in Examples 1 and 2, the surface of the thin water-soluble resin coating layer was coated thinly and uniformly with shell particles, and therefore high blocking resistance and good low-temperature fixation performance could be realized.

In Comparative Example 1, the surfaces of the toner base particles were observed with a scanning electronic microscope, and there was confirmed only a little adhesion of shell particles to the surfaces. This is considered because a monomer was used as the water-soluble resin coating layer component, a water-soluble resin coating layer was not formed on the surface of the core and therefore shell particles would not have adhered to the layer. Since no shell was formed, the blocking resistance was insufficient.

In Comparative Example 2, the blocking resistance was good but the fixation performance was insufficient. The reason is considered because the water-soluble resin coating layer was formed of fine particles, the water-soluble resin coating layer was thick and the ratio of the total of the water-soluble resin coating layer and the shell layer in the entire toner increased, and as a result, the low-temperature fixation performance would be thereby worsened. It is presumed that, when the ratio of the water-soluble resin coating layer is further increased, the low-temperature fixation performance would be thereby more hardly realized. Similarly, when the ratio of the shell layer is increased, the low-temperature fixation performance would be also hardly realized.

The weight-average molecular weight (Mw) and the glass transition temperature (Tg) were measured as follows. The other items were measured in the same manner as above.

<Weight-Average Molecular Weight (Mw)>

The THF-soluble component of a dried product of the polymer primary particle dispersion and the shell particle dispersion was analyzed through gel permeation chromatography (GPC) under the following condition.

Apparatus: Tosoh's GPC device, HLC-8320

Column: TOSOH TSKgel, SuperHM-H (×2)

Solvent: THF

Sample concentration: 0.1 wt %

Calibration curve: standard polystyrene

<Glass transition temperature (Tg)>Using a differential thermal analyzer (DSC 220) manufactured by Seiko Instruments Inc., a dried sample was analyzed under the condition of a heating rate 10° C./min. Tg was obtained from the intersection of the extended line from the base line of the DSC curve and the tangent line showing the maximum inclination of the endothermic curve.

Example 3

<Preparation of Polymer Primary Particle Dispersion B3>

A polymer primary particle dispersion B3 was produced according to the same method as that for B1 except that the monomers were changed as follows. The median diameter (D50) measured with Nanotrac was 258 nm. The weight-average molecular weight (Mw) was 114000. Tg was 36° C.

[Monomers]

| | |
|---|---|
| Styrene | 67.8 parts |

-continued

| | |
|---|---|
| Butyl acrylate | 32.2 parts |
| Acrylic acid | 1.5 parts |
| Trichlorobromomethane | 1.0 part |
| Hexanediol diacrylate | 0.7 parts |

<Preparation of Core Particle Dispersion C3>

A core particle dispersion C3 was produced according to the same method as that for C1, except that the polymer primary particle dispersion B3 was used in place of B1 and that 7.6 parts (solid content) of EP-700 (manufactured by Dainichi Seika Color & Chemicals Mgf. Co., Ltd., PB15:3 dispersion) was used in place of the black colorant dispersion.

<Production of Toner Base Particles F5>

70 parts (solid content) of the core particle dispersion C3 and 30 parts of desalted water were put in a reactor equipped with a stirring device and a heating and cooling device, and with stirring at room temperature, 0.15 parts (solid content) of the water-soluble resin coating layer aqueous solution D1 was added and stirred at room temperature for 15 minutes. Subsequently, 1 N—NaOH aqueous solution was added in an amount of 7.5 g/1 L dispersion volume, and then kept stirred for 15 minutes. 3 parts (solid content) of the shell particle dispersion E1 was dropwise added and stirred at room temperature for 15 minutes. Subsequently, 1 N—HCl aqueous solution was added in an amount of 10 g/1 L dispersion volume, and kept stirred for 15 minutes, and thereafter the dispersion was heated up to an internal temperature of 45° C., kept as such for 60 minutes, and then cooled to 30° C. The volume median diameter (Dv50) measured with Multisizer III was 7.5 μm, and the mean circularity measured with a flow particle analyzer was 0.964.

The resultant dispersion was taken out and filtered under reduced pressure through an aspirator using filter paper of Grade No. 5C. The cake having remained on the filter paper was transferred into a stainless container equipped with a stirrer (with propellers), and desalted water having an cicctroconductivity of 1 μS/cm was added and uniformly dispersed with stirring at 50 rpm, and thereafter further stirred for 60 minutes.

This step was repeated until the electroconductivity of the filtrate could reach 2 μS/cm, and then the resultant cake was dried in an air drier set at 40° C. for 48 hours to give toner base particles F5.

<Production of Toner G5 for Development>

100 parts of the toner base particles F5 were put in a sample mill KR-3 manufactured by Kyoritsu Riko Co., Ltd., and subsequently 0.8 parts of PDMS-processed silica fine particles having a volume-average primary particle size of 0.1 μm and 0.8 parts of PDMS-processed silica fine particles having a volume-average primary particle size of 0.12 μm were added thereto and mixed by stirring for a total of 1.5 minutes. Subsequently, 0.3 parts of alkylsilane-processed titania fine particles having a volume-average primary particle size of 0.014 μm, 0.4 parts of PDMS-processed silica fine particles having a volume-average primary particle size of 0.015 μm, and 0.2 parts of PDMS/aminosilane-processed silica fine particles having a volume-average primary particle size of 0.01 μm were added and mixed by stirring for a total of 1.5 minutes. Subsequently, 0.2 parts of resin beads having a volume-average primary particle size of 0.2 μm were added and mixed by stirring for 1.5 minutes, and sieved to give a toner G5 for development.

<Preparation of Core Particle Dispersion C4>

A core particle dispersion C4 was produced according to the same method as that for C3 except that 6.6 parts of EP-700 was used.

<Production of Toner Base Particles F6>

Toner base particles F6 were produced according to the same method as that for F5, except that the core particle dispersion C4 was used in place of C3, that 0.075 parts (solid content) of PAS-J-81 (manufactured by Nittobo Medical Co., Ltd., diallyldimethylammonium chloride/acrylamide copolymer 25% aqueous solution, weight-average molecular weight (Mw) in catalog 870,000) was used in place of the water-soluble resin coating layer aqueous solution D1, and that 3.5 parts (solid content) of a styrene/2-ethylhexyl acrylate/2-acrylamide-2-methylpropanesulfonic acid copolymer aqueous dispersion (containing 2.7 wt % of 2-acrylamide-2-methylpropanesulfonic acid, and having a weight-average molecular weight (Mw) of 14,200, Tg of 70° C., a median diameter (D50) measured with Nanotrack of 24 nm and a solid concentration of 20 wt %) was used in place of the shell particle dispersion E1. The volume median diameter (Dv50) measured with Multisizer III before washing was 7.4 μm, and the mean circularity measured with a flow particle analyzer was 0.969.

<Production of Toner G6 for Development>

A toner G6 for development was produced in the same manner as that for G5 except that the toner base particles F6 were used in place of F5.

Example 5

<Preparation of Wax Dispersion A2>

29.8 parts of ester wax, Nissan Electol WE-10 (manufactured by NOF, melting point in catalog 69° C., 0.1% weight reduction time 19 minutes), 0.24 parts of decaglycerin decabehenate (acid value 3.2 mg KOH/g, hydroxyl value 27 mg KOH/g), 2.75 parts of 20% DBS aqueous solution and 67.25 parts of desalted water were heated at 90° C. and stirred for 20 minutes. Next, with heating at 100° C. and using a high-pressure emulsifying machine, circulating emulsification was started under a pressure condition of 30 MPa to disperse the mixture so that the median diameter (D50) of the resultant particles could be 245 nm or less to prepare a wax dispersion A2, while the particle diameter was measured with Nanotrac. The final particle diameter (D50) was 232 nm.

<Preparation of Polymer Primary Particle Dispersion B4>

A polymer primary particle dispersion B4 was produced according to the same method as that for B1 except that the wax dispersion A1 was changed to 41.6 parts of A2 and the monomers were changed as follows. The median diameter (D50) measured with Nanotrac was 210 nm. The weight-average molecular weight (Mw) was 264000. Tg was 38° C.

[Monomers]

| | |
|---|---|
| Styrene | 69.1 parts |
| Butyl acrylate | 30.9 parts |
| Acrylic acid | 1.5 parts |
| Trichlorobromomethane | 1.0 part |
| Hexanediol diacrylate | 0.7 parts |

<Preparation of Polymer Primary Particle Dispersion B5>

A polymer primary particle dispersion B5 was produced according to the same method as that for B1 except that the monomers were changed as follows. The weight-average molecular weight (Mw) was 92000. Tg was 48° C.

[Monomers]

| | |
|---|---|
| Styrene | 76.8 parts |
| Butyl acrylate | 23.2 parts |
| Acrylic acid | 1.5 parts |
| Trichlorobromomethane | 1.0 part |
| Hexanediol diacrylate | 0.7 parts |

<Preparation of Core Particle Dispersion C5>

97 parts (solid content) of the polymer primary particle dispersion B4 was put in a mixer equipped with a stirring device, a heating and cooling device, and source material/auxiliary agent feeding devices, and further, 6.6 parts of EP-700 was added, taking 5 minutes, and mixed uniformly, and then 0.31 parts (solid content) of 0.5% aluminium sulfate aqueous solution was added taking 15 minutes. Further, this was heated up to an internal temperature of 44° C. taking 170 minutes. Here, the volume median diameter (Dv50) was measured with Multisizer, and was 6.4 μm. Subsequently, 3 parts (solid content) of the polymer primary particle dispersion B5 was added taking 3 minutes, and then kept stirred for 30 minutes. Subsequently, 4.1 parts (solid content) of 20% DBS aqueous solution was added, then heated up to 84° C. taking 50 minutes, kept as such for 60 minutes, and thereafter cooled to 30° C. Subsequently, in the same manner as that for C3, this was filtered, washed and dispersed to give a core particle dispersion C5.

<Preparation of Shell Particle Dispersion E2>

A shell particle dispersion E2 was prepared according to the same method as that for E1 except that the monomers 1 were changed as follows. The median diameter (D50) measured with Nanotrac was 58 nm. The weight-average molecular weight (Mw) was 57000. Tg was 75° C.

[Monomers 1]

| | |
|---|---|
| Styrene | 88.0 parts |
| Butyl acrylate | 12.0 parts |
| 1-Dodecanethiol | 0.5 parts |

<Production of Toner Base Particles F7>

Toner base particles F7 were produced according to the same method as that for F5 except that the core particle dispersion C5 was used in place of C3 and that the shell particle dispersion E2 was used in place of E1. The volume median diameter (Dv50) measured with Multisizer III before washing was 6.8 μm, and the mean circularity measured with a flow particle analyzer was 0.970.

<Production of Toner G7 for Development>

A toner G7 for development was produced in the same manner as that for G5 except that the toner base particles F7 were used in place of F5.

Example 6

<Preparation of Polymer Primary Particle Dispersion B6>

A polymer primary particle dispersion B6 was produced according to the same method as that for B4 except that the monomers were changed as follows. The median diameter (D50) measured with Nanotrac was 205 nm. The weight-average molecular weight (Mw) was 269000. Tg was 36° C.

[Monomers]

| | |
|---|---|
| Styrene | 68.2 parts |
| Butyl acrylate | 31.8 parts |
| Acrylic acid | 1.5 parts |
| Trichlorobromomethane | 1.0 part |
| Hexanediol diacrylate | 0.8 parts |

<Preparation of Core Particle Dispersion C6>

A core particle dispersion C6 was produced in the same manner as that for C5, except that 83 parts (solid content) of the polymer primary particle dispersion B6 was used in place of B4, and 17 parts (solid content) of the polymer primary particle dispersion B3 was used in place of B5.

<Production of Toner Base Particles F8>

Toner base particles F8 were produced according to the same method as that for F6 except that the core particle dispersion C6 was used in place of C4 and that the amount of the styrene/2-ethylhexyl acrylate/2-acrylamide-2-methylpropanesulfonic acid copolymer dispersion was changed to 3.0 parts (solid content). The volume median diameter (Dv50) measured with Multisizer III before washing was 7.3 μm, and the mean circularity measured with a flow particle analyzer was 0.968.

<Production of Toner G8 for Development>

A toner G8 for development was produced in the same manner as that for G5 except that the toner base particles F8 were used in place of F5.

Example 7

<Preparation of Core Particle Dispersion C7>

A core particle dispersion C7 was produced in the same manner as that for C6, except that 90 parts (solid content) of the polymer primary particle dispersion B6 was used and 10 parts (solid content) of the polymer primary particle dispersion B3 was used.

<Production of Toner Base Particles F9>

Toner base particles F9 were produced according to the same method as that for F6 except that the core particle dispersion C7 was used in place of C4. The volume median diameter (Dv50) measured with Multisizer III before washing was 6.9 μm, and the mean circularity measured with a flow particle analyzer was 0.966.

<Production of Toner G9 for Development>

A toner G9 for development was produced in the same manner as that for G5 except that the toner base particles F9 were used in place of F5.

Example 8

<Preparation of Polymer Primary Particle Dispersion B7>

A polymer primary particle dispersion B7 was produced according to the same method as that for B4 except that the monomers were changed as follows. The median diameter (D50) measured with Nanotrac was 203 nm. The weight-average molecular weight (Mw) was 403000. Tg was 37° C.

[Monomers]

| | |
|---|---|
| Styrene | 69.1 parts |
| Butyl acrylate | 30.9 parts |
| Acrylic acid | 1.5 parts |
| Trichlorobromomethane | 1.0 part |
| Hexanediol diacrylate | 0.5 parts |

<Preparation of Wax Dispersion A3>

A wax dispersion A3 was produced in the same manner as that for A2, except that Nissan Electol WEP-5 (manufactured by NOF, melting point in catalog 82° C., 0.1% weight reduction time 55 minutes) was used in place of Nissan Electol WE-10. The final particle diameter (D50) was 238 nm.

<Preparation of Polymer Primary Particle Dispersion B8>

A polymer primary particle dispersion B8 was produced according to the same method as that for B4 except that the wax dispersion A2 was changed to A3 and that the monomers were changed as follows. The median diameter (D50) measured with Nanotrac was 205 nm. The weight-average molecular weight (Mw) was 304000. Tg was 38° C.

[Monomers]

| | |
|---|---|
| Styrene | 65.5 parts |
| Butyl acrylate | 34.5 parts |
| Acrylic acid | 1.5 parts |
| Trichlorobromomethane | 1.0 part |
| Hexanediol diacrylate | 0.7 parts |

<Preparation of Core Particle Dispersion C8>

A core particle dispersion C8 was produced in the same manner as that for C5, except that 85 parts (solid content) of the polymer primary particle dispersion B7 was used in place of B4, and 15 parts (solid content) of the polymer primary particle dispersion B8 was used in place of B5.

<Production of Toner Base Particles F10>

Toner base particles F10 were produced according to the same method as that for F6 except that the core particle dispersion C8 was used in place of C4. The volume median diameter (Dv50) measured with Multisizer III before washing was 7.7 μm, and the mean circularity measured with a flow particle analyzer was 0.973.

<Production of Toner G10 for Development>

A toner G10 for development was produced in the same manner as that for G5 except that the toner base particles F10 were used in place of F5.

Example 9

<Preparation of Magenta Colorant Dispersion

A magenta colorant dispersion was prepared in the same manner as that for the black colorant dispersion, except that Pigment Red 122 was used in place of carbon black.

<Preparation of Core Particle Dispersion C9>

A core particle dispersion C9 was produced in the same manner as that for C8, except that 12.1 parts of the magenta colorant dispersion was used in place of EP-700.

<Production of Toner Base Particles F11>

Toner base particles F11 were produced according to the same method as that for F6 except that the core particle dispersion C9 was used in place of C4. The volume median diameter (Dv50) measured with Multisizer III before washing was 7.0 μm, and the mean circularity measured with a flow particle analyzer was 0.969.

<Production of Toner G11 for Development>

100 parts of the toner base particles F11 were put in a sample mill KR-3 manufactured by Kyoritsu Riko Co., Ltd., and subsequently 1.8 parts of PDMS-processed silica fine particles having a volume-average primary particle size of 0.1 μm and 0.3 parts of PDMS-processed silica fine particles having a volume-average primary particle size of 0.06 μm were added thereto and mixed by stirring for a total of 1.5 minutes. Subsequently, 0.6 parts of alkylsilane-processed titania fine particles having a volume-average primary particle size of 0.014 μm, 0.6 parts of PDMS-processed silica fine particles having a volume-average primary particle size of 0.015 μm, and 0.1 parts of PDMS/aminosilane-processed silica fine particles having a volume-average primary particle size of 0.01 μM were added and mixed by stirring for a total of 1.5 minutes. Subsequently, 0.2 parts of resin beads having a volume primary particle size of 0.2 μm were added and mixed by stirring for 1.5 minutes, and sieved to give a toner G11 for development.

Comparative Example 3

<Production of Toner Base Particles F12>

Aggregation was carried out in the same manner as that for C3 except that the polymer primary particle dispersion B5 was used in place of B3, and then, in the same manner as that for F5 but not forming a water-soluble resin coating layer and a shell layer, the mixture was filtered, washed and dried to give toner base particles F12. The volume median diameter (Dv50) measured with Multisizer III before filtration was 6.8 μm. The mean circularity measured with a flow particle analyzer was 0.972.

<Production of Toner G12 for Development>

A toner G12 for development was produced in the same manner as that for G5 except that the toner base particles F12 were used in place of F5.

Comparative Example 4

<Preparation of Wax Dispersion A4>

A wax dispersion A4 was produced in the same manner as that for A2, except that 29.7 parts of HiMic-1090 (manufactured by Nippon Seiro Co., melting point in catalog 89° C.) was used in place of Nissan Electol WE-10 and that the amount of decaglycerin decabehenate was changed to 0.3 parts.

<Preparation of Polymer Primary Particle Dispersion B9>

A polymer primary particle dispersion B9 was produced according to the same method as that for B3 except that the wax dispersion A1 was changed to 35.0 parts of the wax dispersion A4 and that the monomers were changed as follows. The weight-average molecular weight (Mw) was 81000.

[Monomers]

| | |
|---|---|
| Styrene | 75.9 parts |
| Butyl acrylate | 24.1 parts |
| Acrylic acid | 1.2 parts |
| Trichlorobromomethane | 1.0 part |
| Hexanediol diacrylate | 0.7 parts |

<Production of Toner Base Particles F13>

Aggregation was carried out in the same manner as that for C5 except that, in place of the polymer primary particle dispersion B4, 80 parts (solid content) of the polymer primary particle dispersion B9 and 20 parts (solid content) of the polymer primary particle dispersion B5 were used, then, in the same manner as that for F5 but not forming a water-soluble resin coating layer and a shell layer, the mixture was filtered, washed and dried to give toner base particles F13. The volume median diameter (Dv50) measured with Multisizer III before filtration was 7.3 μm. The mean circularity measured with a flow particle analyzer was 0.963.

<Production of Toner G13 for Development>

A toner G13 for development was produced in the same manner as that for G5 except that the toner base particles F13 were used in place of F5.

The toners for development obtained in Examples 3 to 9 and Comparative Examples 3 to 4 were evaluated according to the following methods. The results are shown in Table 2.

[Fixation Test]

A recording sheet (Excellent White manufactured by Oki Data Co., Ltd.) carrying an unfixed toner image thereon was prepared and tested in the manner mentioned below, using two types of fixing machines of a heating roller fixation system.

Fixing Machine A

The roller diameter is 27 mm, the nip width is 9 mm, and the fixation rate is 229 mm/sec. The upper roller has a heater, the roller surface is formed of PFA (tetrafluoroethylene-perfluoroalkyl vinyl ether copolymer), and silicone oil is not applied thereto.

Fixing Machine B

The roller diameter is 34 mm, the nip width is 7 mm, and the fixation rate is 195 mm/sec. The upper roller has a heater, the roller surface is formed of PFA (tetrafluoroethylene-perfluoroalkyl vinyl ether copolymer), and silicone oil is not applied thereto.

<Low-Temperature Fixation Performance Test by Tape Peeling>

The roller surface temperature was lowered from 170° C. at intervals of 5° C., and a recording sheet carrying thereon an unfixed toner image in an adhesion amount of about 0.4 mg/cm$^2$ was introduced into the fixation nip part to form a fixed image. A mending tape was stuck to the fixed image, and a weight of 2 kg was led to pass on the tape for close adhesion of the fixed image. The mending tape was peeled, and the degree of transfer of the fixed image to the tape was visually determined.

Fixing Machines A, B

A: Fixed at 140° C. or lower.
B: Fixed at 145° C.
C: Fixed at 150° C.
D: Fixed only when the temperature is 155° C. or higher.

<Low-Temperature Fixation Performance Test by Folding>

The roller surface temperature was lowered from 170° C. at intervals of 5° C., and a recording sheet carrying thereon an unfixed toner image in an adhesion amount of about 1.0 mg/cm$^2$ was introduced into the fixation nip part to form a fixed image. The sheet was folded in half with the fixed image facing inward, and a weight of 2 kg was led to pass on the fold line. The fixed image was opened, and the degree of toner peeling in the folded part was visually determined.

Fixing Machine A

A: Fixed at 140° C. or lower.
B: Fixed at 145° C.
C: Fixed at 150° C.
D: Fixed only when the temperature is 155° C. or higher.

Fixing Machine B

A: Fixed at 135° C. or lower.
B: Fixed at 140° C.
C: Fixed at 145° C.
D: Fixed only when the temperature is 150° C. or higher.

<Hot Offset Resistance Test>

The roller surface temperature was raised from 175° C. at intervals of 5° C., and a recording sheet carrying thereon an unfixed toner image was introduced into the fixation nip part to form a fixed image, and the discharged state was observed.

Fixing Machine A

A: No offset at 195° C.
B: Offset occurred at 195° C.
C: Offset occurred at 190° C.
D: Offset occurred at 185° C. or lower.

Fixing Machine B

A: No offset at 210° C.
B: Offset occurred at 200 to 210° C.
C: Offset occurred at 180 to 195° C.
D: Offset occurred at 175° C. or lower.

[Blocking Resistance]

10 g of the toner for development was put in a cylindrical container having an inner diameter of 3 cm and a height of 6 cm, a load of 20 g was applied thereto, and left in an environment at a temperature of 50° C. and a humidity of 55% for 48 hours, and then the toner was taken out of the container, and a load was applied thereto from the above to confirm the degree of aggregation of the toner.

A: Crushed under a load of less than 100 g.
B: Crushed under a load of from 100 g to less than 200 g.
C: Crushed under a load of from 200 g to less than 300 g.
D: Crushed only when given a load of 300 g or more.

[Charging Property]

As a carrier, FMU65 manufactured by Kanto Denka Kogyo Co., Ltd. was used, and 10 g of a mixture of the toner for development and the carrier in a ratio by weight of 1/24 was put in a glass sample bottle. This was shaken using NR-1 manufactured by Taitec Corporation. 0.1 g was sampled, and the charging amount thereof was measured according to a suction blow-off method using a blow-off charging amount measuring device manufactured by Toshiba Chemical Corporation.

Blow condition: 0.05 kgf/cm$^2$×3 sec
Suction pressure: 350 to 400 mmH$_2$O
Screen: 400 mesh The sample was measured three times for a shaking time of 1 minute, 5 minutes or 30 minutes, and was evaluated as follows. Q means the charging amount.

A: $Q \leq -18$ (μC/g) all the three times.
B: $Q \leq -13$ (μC/g) all the three times, and at least once of the three times, $-18 < Q \leq -13$ (μC/g).
C: $-13 < Q$ (μC/g) at least once of the three times.

[Ultrafine Particles Generation Amount]

A recording sheet (Excellent White manufactured by Oki Data Co., Ltd.) having a length of 4 cm and a width of 20 cm and carrying an unfixed toner image thereon in an adhesion amount of about 1.0 mg/cm$^2$ was prepared and fixed using the fixing machine A in which the fixation rate was 229 mm/sec and the fixation temperature was 170° C. With respect to the amount of the ultrafine particles discharged during this along with the exhaust gas, the number of the particles having a particle size of from 0.02 to 1.0 μm was counted using P-Trac Ultraparticle Counter Model 8525 manufactured by TSI Incorporated. A white sheet not carrying an toner image was tested in the same manner as above. The value obtained by subtracting the number of the detected particles during white sheet passage from the number of the detected particles during unfixed toner passage was referred to as the ultrafine particles generation amount, and the samples were evaluated as follows.

A: Less than 50,000.
B: From 50,000 to 100,000 or less.
C: From 100,000 to 200,000 or less.
D: 200,000 or more.

[BET Specific Surface Area]

The BET specific surface area of the toner base particles and the toner for development was measured according to a one-point method using Macsorb Model 1208 manufactured by Mountech Co., Ltd.

Measurement sample amount: about 0.5 g
Measurement gas: mixed gas of nitrogen 30% and helium 70%

Flow rate: 25 mL/min

TABLE 2

| | Example 3 | Example 4 | Example 5 | Example 6 | Example 7 | Example 8 | Example 9 | Comparative Example 3 | Comparative Example 4 |
|---|---|---|---|---|---|---|---|---|---|
| Low Temperature Fixation Performance Fixing Machine A Tape Peeling Test | C | C | B | C | C | B | B | D | D |
| Low Temperature Fixation Performance Fixing Machine A Folding Test | B | B | A | B | C | B | A | D | D |
| Low Temperature Fixation Performance Fixing Machine B Tape Peeling Test | B | C | — | A | A | C | — | D | D |
| Low Temperature Fixation Performance Fixing Machine B Folding Test | B | C | — | C | B | A | — | D | D |
| Hot-Offset Resistance Fixing Machine A Adhesion Amount 0.4 mg/cm$^2$ | A | A | B | A | A | A | A | A | A |
| Hot-Offset Resistance Fixing Machine A Adhesion Amount 1.0 mg/cm$^2$ | A | A | B | A | A | A | A | A | A |
| Hot-Offset Resistance Fixing Machine B Adhesion Amount 0.4 mg/cm$^2$ | A | A | — | A | A | A | — | A | A |
| Hot-Offset Resistance Fixing Machine B Adhesion Amount 1.0 mg/cm$^2$ | A | A | — | A | A | C | — | A | C |
| Blocking Resistance | B | A | C | C | B | B | C | B | B |
| Charging Property | C | B | C | B | B | B | C | B | — |
| UFP | D | — | A | — | — | A | C | — | — |
| BET Specific Surface Area Toner base particles | 1.9 | — | 2.14 | 1.28 | 1.63 | 1.41 | 1.46 | 0.955 | — |
| BET Specific Surface Area Toner for Development | 1.87 | — | 1.88 | 1.61 | 1.77 | 1.58 | 1.83 | 1.53 | — |

While the present invention has been described in detail and with reference to specific embodiments thereof, it will be apparent to one skilled in the art that various changes and modifications can be made therein without departing from the spirit and scope thereof. This application is based upon a Japanese patent application filed on Aug. 29, 2013 (Patent Application 2013-178429), a Japanese patent application filed on Mar. 13, 2014 (Patent Application 2014-050705) and a Japanese patent application filed on Mar. 24, 2014 (Patent Application 2014-060709), and the contents thereof are incorporated herein by reference.

The invention claimed is:

1. An electrostatic image developing toner comprising a toner base particle containing at least a binder resin and a colorant, and an external additive, wherein:

the toner base particle has a core-shell structure having a core particle and a shell layer, the toner base particle has a resin coating layer of a water-soluble resin on the surface of the core particle, and has the shell layer on the resin coating layer, and the shell layer is formed of a particle comprising a resin as a main ingredient, and when a glass transition temperature of a polymer primary particle to constitute the core particle is referred to as Tg1, and a glass transition temperature of the particle to constitute the shell layer is referred to as Tg2, the Tg1 and Tg2 satisfy the following relationship:

$$25° C. \leq Tg1 \leq 45° C.$$

$$55° C. \leq Tg2$$

$$Tg2 - Tg1 \geq 20.$$

2. The electrostatic image developing toner according to claim 1, wherein the particle to constitute the shell layer contains a resin having a sulfonic acid group.

3. The electrostatic image developing toner according to claim 2, wherein charging properties of the core particle and the resin coating layer are in an opposite relationship to each other, and wherein charging properties of the resin coating layer and the shell layer are in an opposite relationship to each other.

4. The electrostatic image developing toner according to claim 1, wherein the core particle is obtained according to a polymerization method.

5. The electrostatic image developing toner according to claim 1, wherein charging properties of the core particle and the resin coating layer are in an opposite relationship to each other, and wherein charging properties of the resin coating layer and the shell layer are in an opposite relationship to each other.

6. The electrostatic image developing toner according to claim 5, wherein a wax contained in a core layer of the core particle having a capsule structure is a wax where the time until the weight loss thereof at 200° C., as measured with a thermogravimetric analyzer, reaches 0.1%, is 15 minutes or more, and wherein a melting point of a wax contained in a shell layer of the core particle having a capsule structure is 70° C. or higher.

7. The electrostatic image developing toner according to claim 1, wherein the core particle has a capsule structure.

8. The electrostatic image developing toner according to claim 1, wherein a wax contained in a core layer of the core particle having a capsule structure is a wax where the time until the weight loss thereof at 200° C., as measured with a thermogravimetric analyzer, reaches 0.1%, is 15 minutes or more, and wherein a melting point of a wax contained in a shell layer of the core particle having a capsule structure is 70° C. or higher.

9. The electrostatic image developing toner according to claim 1, wherein the toner base particle is obtained through a process comprising mixing a dispersion of core particles with an aqueous solution containing the water-soluble resin to adhere the water-soluble resin to the surface of the core particle, and further mixing therein a dispersion of particles to constitute the shell layer to adhere the particles to constitute the shell layer.

10. The electrostatic image developing toner according to claim 1, wherein the toner base particle is obtained through a process comprising mixing a dispersion of core particles with an aqueous solution containing a water-soluble resin that has a charging property opposite to that of the core particles to adhere the water-soluble resin to the surface of the core particle and further mixing therein a dispersion of particles to constitute the shell layer that has a charging property opposite to that of the water-soluble resin to adhere the particles to constitute the shell layer.

* * * * *